US011188014B2

(12) United States Patent
Seshita

(10) Patent No.: US 11,188,014 B2
(45) Date of Patent: Nov. 30, 2021

(54) FIXING DEVICE AND IMAGE FORMING APPARATUS INCLUDING SAME

(71) Applicant: Ricoh Company, Ltd., Tokyo (JP)

(72) Inventor: Takuya Seshita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/984,229

(22) Filed: Aug. 4, 2020

(65) Prior Publication Data

US 2021/0041815 A1 Feb. 11, 2021

(30) Foreign Application Priority Data

Aug. 8, 2019 (JP) ..... JP2019-146760

(51) Int. Cl.
*G03G 15/20* (2006.01)
*G03G 15/16* (2006.01)
*G03G 15/00* (2006.01)

(52) U.S. Cl.
CPC ..... *G03G 15/2039* (2013.01); *G03G 15/167* (2013.01); *G03G 15/2028* (2013.01); *G03G 15/5004* (2013.01)

(58) Field of Classification Search
None
See application file for complete search history.

(56) References Cited

U.S. PATENT DOCUMENTS

2005/0231126 A1* 10/2005 Nara ..... G03G 15/5004 315/210
2012/0121303 A1 5/2012 Takagi et al.
2013/0183072 A1 7/2013 Hase et al.
2013/0188979 A1* 7/2013 Okada ..... H02J 4/00 399/88
2013/0195477 A1 8/2013 Seshita et al.
2013/0195493 A1 8/2013 Hase et al.
2013/0202320 A1 8/2013 Hase et al.
2013/0209115 A1 8/2013 Hase et al.
(Continued)

FOREIGN PATENT DOCUMENTS

JP 2010-134130 6/2010
JP 2014-029405 2/2014

OTHER PUBLICATIONS

JP_2014029405_A_T MachineTranslation, Japan, Feb. 2014, Motomiya.*

*Primary Examiner* — Victor Verbitsky
(74) *Attorney, Agent, or Firm* — Xsensus LLP

(57) ABSTRACT

An image forming apparatus includes a fixing device, control circuitry, and a controller. The fixing device includes a first rotating body, a second rotating body in pressure contact with the first rotating body, and a heat source to heat the first rotating body. The circuitry, at startup of the fixing device, causes the fixing device to perform a rotating operation to rotate the first rotating body while causing the heat source to perform a heating operation to heat the first rotating body, thereby performing a fixing startup operation to raise a temperature of the first rotating body. The circuitry delays at least one of a timing for start of the rotating operation and a timing for start of the heating operation to be later than a start of a controller startup operation such that the fixing startup operation is completed in time with completion of the controller startup operation.

14 Claims, 17 Drawing Sheets

(56) References Cited

U.S. PATENT DOCUMENTS

| | | | |
|---|---|---|---|
| 2013/0209121 | A1 | 8/2013 | Uchitani et al. |
| 2013/0209131 | A1 | 8/2013 | Uchitani et al. |
| 2014/0133879 | A1 | 5/2014 | Seshita et al. |
| 2014/0270834 | A1 | 9/2014 | Seshita et al. |
| 2017/0010569 | A1 | 1/2017 | Seshita et al. |

* cited by examiner

WITHOUT NEED FOR PERIPHERAL DEVICE

WITH NEED FOR PERIPHERAL DEVICE A (CONTROLLER STARTUP TIME < PERIPHERAL DEVICE STARTUP TIME)

WITH NEED FOR PERIPHERAL DEVICE B (CONTROLLER STARTUP TIME > PERIPHERAL DEVICE STARTUP TIME)

AT OCCURRENCE OF ADDITIONAL CONTROL

FIXING DEVICE AND IMAGE FORMING APPARATUS INCLUDING SAME

CROSS-REFERENCE TO RELATED APPLICATION

This patent application is based on and claims priority pursuant to 35 U.S.C. § 119(a) to Japanese Patent Application No. 2019-146760, filed on Aug. 8, 2019, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Related Art

There has been conventionally known a fixing device that has a first rotating body to be heated by a heat source and a second rotating body to be in pressure contact with the first rotating body, and at the time of startup, performs a rotating operation to rotate the first rotating body while performing a heating operation to heat the first rotating body by the heat source, thereby performing a fixing startup operation to raise the temperature of the first rotating body to a predetermined temperature.

SUMMARY

In an aspect of the present disclosure, there is provided an image forming apparatus that includes a fixing device, control circuitry, and a controller. The fixing device includes a first rotating body, a second rotating body in pressure contact with the first rotating body, and a heat source configured to heat the first rotating body. The control circuitry is configured to control components of the image forming apparatus. The controller is configured to issue an image forming command to the control circuitry. The control circuitry is configured to, at startup of the fixing device, cause the fixing device to perform a rotating operation to rotate the first rotating body while causing the heat source to perform a heating operation to heat the first rotating body, thereby performing a fixing startup operation to raise a temperature of the first rotating body to a predetermined temperature. The control circuitry is configured to delay at least one of a timing for start of the rotating operation and a timing for start of the heating operation in the fixing startup operation to be later than a start of a controller startup operation of starting up the controller such that the fixing startup operation is completed in time with completion of the controller startup operation.

In another aspect of the present disclosure, there is provided an image forming apparatus that includes a fixing device, control circuitry, and a controller. The fixing device includes a first rotating body, a second rotating body in pressure contact with the first rotating body, and a heat source configured to heat the first rotating body. The control circuitry is configured to control components of the image forming apparatus. The controller is configured to issue an image forming command to the control circuitry. The control circuitry is configured to, at startup of the fixing device, cause the fixing device to perform a rotating operation to rotate the first rotating body while causing the heat source to perform a heating operation to heat the first rotating body, thereby performing a fixing startup operation to raise a temperature of the first rotating body to a predetermined temperature. The control circuitry is configured to delay at least one of a timing for start of the rotating operation and a timing for start of the heating operation in the fixing startup operation to be later than a start of one of a controller startup operation of starting up the controller and a peripheral device startup operation of starting up a peripheral device connected to the image forming apparatus, which is completed later than the other of the controller startup operation and the peripheral device startup operation, such that the fixing startup operation is completed in time with completion of the one of the controller startup operation and the peripheral device startup operation.

In still another aspect of the present disclosure, there is provided an image forming apparatus that includes an image forming device, a fixing device, control circuitry, and a controller. The image forming device is configured to form an image. The fixing device includes a first rotating body, a second rotating body in pressure contact with the first rotating body, and a heat source configured to heat the first rotating body. The control circuitry is configured to control components of the image forming apparatus. The controller is configured to issue an image forming command to the control circuitry. The control circuitry is configured to, at startup of the fixing device, cause the fixing device to perform a rotating operation to rotate the first rotating body while causing the heat source to perform a heating operation to heat the first rotating body, thereby performing a fixing startup operation to raise a temperature of the first rotating body to a predetermined temperature. The control circuitry is configured to delay at least one of a timing for start of the rotating operation and a timing for start of the heating operation in the fixing startup operation to be later than a timing for start of a latest one of a controller startup operation of starting up the controller, an image forming device startup operation of starting up the image forming device, and a peripheral device startup operation of starting up a peripheral device connected to the image forming apparatus, which is completed latest of the controller startup operation, the image forming device startup operation, and the peripheral device startup operation, such that the fixing startup operation is completed in time with completion of the latest one of the controller startup operation, the image forming device startup operation, and the peripheral device startup operation.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
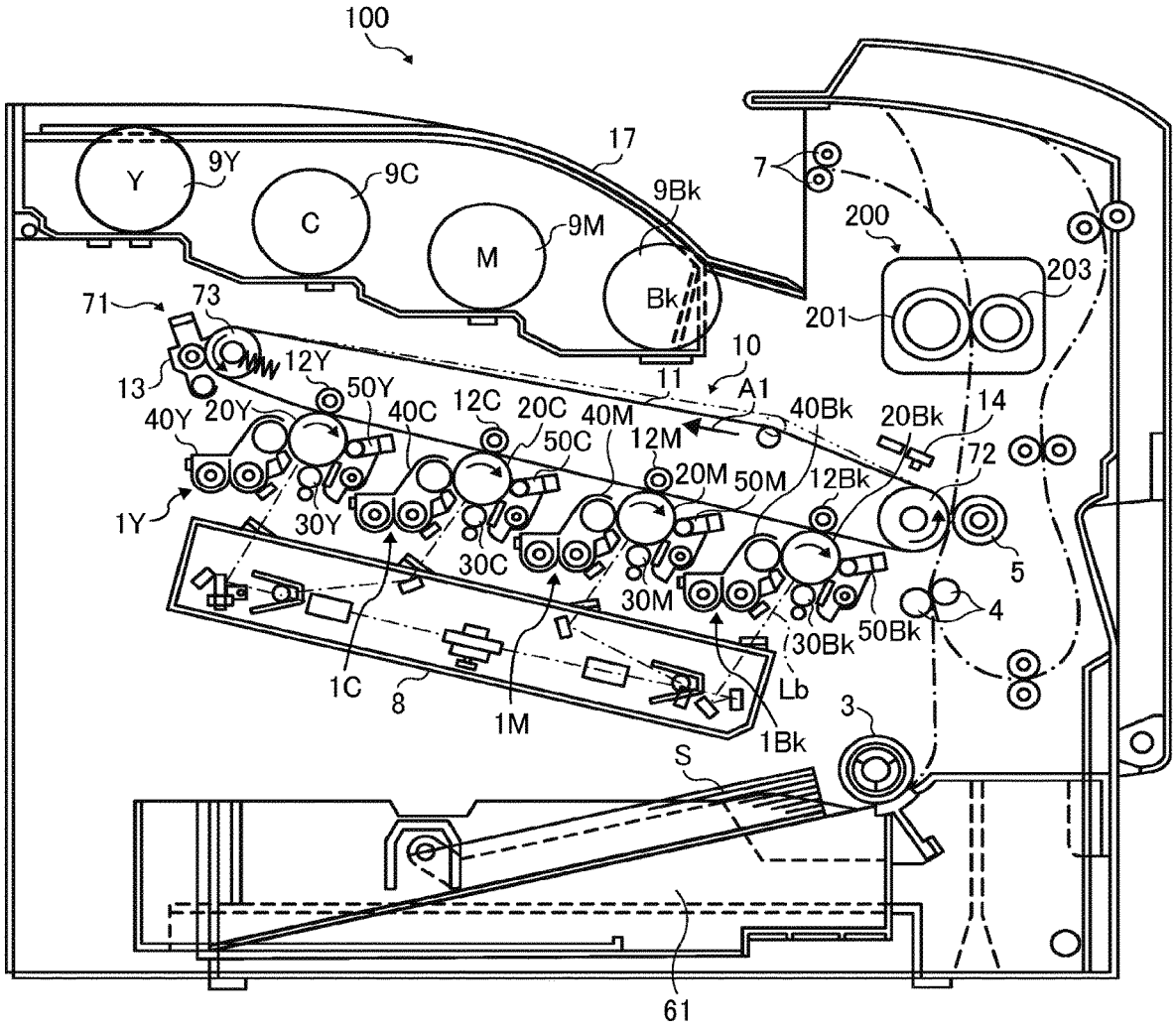
FIG. 1 is a schematic configuration diagram of an image forming apparatus according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

A fixing device in an image forming apparatus according to an embodiment of the present disclosure is described. FIG. 1 is a schematic configuration diagram of an image forming apparatus 100 according to the present embodiment. The image forming apparatus 100 is a tandem-system color printer in which image forming devices 1Y, 1M, 1C and 1Bk for forming a plurality of color images are arranged side by side along a belt extending direction. Embodiments of the present disclosure is not limited to this system and can be applied to not only a printer but also a copying machine, a facsimile machine, or the like.

As illustrated in FIG. 1, the image forming apparatus 100 employs a tandem structure in which four drum-shaped photoconductive drums 20Y, 20C, 20M, and 20Bk are arranged side by side as image bearers that bear yellow, cyan, magenta, and black toner images in separation colors, respectively.

The image forming apparatus 100 includes a transfer belt 11, which is an endless belt serving as an intermediate transferor rotatable in a direction of rotation A1 while facing the photoconductive drums 20Y, 20C, 20M, and 20Bk. In a primary transfer process, the yellow, cyan, magenta, and black toner images formed as visible images on the photoconductive drums 20Y, 20C, 20M, and 20Bk, respectively, are transferred successively onto the transfer belt 11 as the transfer belt 11 rotates in the direction of rotation A1 in FIG. 1. By executing the primary transfer process, the images of respective colors are superimposed and transferred, and then a secondary transfer process is executed on a recording medium S such as a recording sheet to collectively transfer the images.

Each of the photoconductive drums 20Y, 20C, 20M, and 20Bk is surrounded by image forming components that form the yellow, cyan, magenta, and black toner images on the photoconductive drums 20Y, 20C, 20M, and 20Bk as the photoconductive drums 20Y, 20C, 20M, and 20Bk rotate clockwise in FIG. 1 in a rotation direction D20. The image forming device 1Bk that forms a black image will be described as a representative. The image forming device 1Bk has a charging device 30Bk, a developing device 40Bk, a primary transfer roller 12Bk, and a cleaning device 50Bk arranged to perform an image forming process along a rotating direction of the photoconductive drum 20Bk. After the chargers 30Y, 30C, 30M, and 30Bk charge the respective photoconductive drums 20Y, 20C, 20M, and 20Bk, an optical writing device 8 writes electrostatic latent images on the photoconductive drums 20Y, 20C, 20M, and 20Bk with laser beams Lb serving as writing light, respectively.

As the transfer belt 11 rotates in the direction of rotation A1, the yellow, cyan, magenta, and black toner images formed as visible images on the photoconductive drums 20Y, 20C, 20M, and 20Bk, respectively, are primarily transferred onto the transfer belt 11 such that the yellow, cyan, magenta, and black toner images are superimposed one atop another on the transfer belt 11. For this reason, the transfer is performed with timing shifted from the upstream side to the downstream side as seen in the A1 direction by application of a voltage from the primary transfer rollers 12Y, 12C, 12M, and 12Bk which are arranged to face the photoconductive drums 20Y, 20C, 20M, and 20Bk with the transfer belt 11 interposed therebetween.

The photoconductive drums 20Y, 20C, 20M, and 20Bk are aligned in this order in the rotation direction A1 of the transfer belt 11. The photoconductive drums 20Y, 20C, 20M, and 20Bk are located in four image forming stations that form the yellow, cyan, magenta, and black toner images, respectively.

The image forming apparatus 100 has: four image stations that perform an image forming process in corresponding colors; a transfer belt unit 10 that is arranged to face upward the photoconductive drums 20Y, 20C, 20M, and 20Bk and includes the transfer belt 11 and the primary transfer rollers 12Y, 12C, 12M, and 12Bk; a secondary transfer roller 5 that is arranged to face the transfer belt 11 and is driven to rotate together the transfer belt 11; a transfer belt cleaner 13 that is arranged to face the transfer belt 11 and clean the transfer belt 11; and an optical writing device 8 that is arranged to face below the four image stations.

The optical writing device 8 includes, e.g., a semiconductor laser serving as a light source, a coupling lens, an fθ lens, a toroidal lens, a deflection mirror, and a rotatable polygon mirror serving as a deflector. According to image data of yellow, cyan, magenta, and black, the optical writing device 8 emits the laser beams Lb to the photoconductive drums 20Y, 20C, 20M, and 20Bk to form electrostatic latent images on the photoconductive drums 20Y, 20C, 20M, and 20Bk, respectively. In FIG. 1, for the sake of convenience, only the laser beam in the image station for black image is denoted with reference sign Lb, but the same applies to the laser beams in the other image forming devices.

The image forming apparatus 100 has a sheet feeding device 61 as a sheet feeding cassette loaded with recording medium S to be conveyed between the photoconductive drums 20Y, 20C, 20M and 20Bk and the transfer belt 11. The image forming apparatus 100 further has a registration roller pair 4 that delivers the recording medium S having been conveyed from the sheet feeding device 61 toward a transfer unit between each photoconductive drum and the transfer belt 11 at a predetermined timing that matches the timing of forming a toner image by the image station. The image forming apparatus 100 further includes a sensor to detect that a leading end of the recording medium S reaches the registration roller pair 4.

The image forming apparatus 100 further includes a fixing device 200 for fixing the transferred toner image on the recording medium S, and a discharge roller 7 for discharging the fixed recording medium S to the outside of the main body of the image forming apparatus 100. An output tray 17 is situated atop the housing of the image forming apparatus 100. The recording medium S is ejected onto the output tray 17 outside the housing of the image forming apparatus 100 by the discharge roller 7. Below the output tray 17, toner bottles 9Y, 9C, 9M, and 9Bk filled with toners of yellow, cyan, magenta, and black are provided.

The transfer belt unit 10 includes a drive roller 72 and a driven roller 73 around which the transfer belt 11 is wound, in addition to the transfer belt 11 and the primary transfer rollers 12Y, 12C, 12M, and 12Bk. A biasing member, such as a spring, biases the driven roller 73 against the transfer belt 11. With such a configuration, the driven roller 73 serves as a tension applicator that applies tension to the transfer belt 11. The transfer belt unit 10, the primary transfer rollers 12Y, 12C, 12M, and 12Bk, the secondary transfer roller 5, and the transfer belt cleaner 13 constitute a transfer device 71.

The sheet feeding device 61 is arranged under the main body of the image forming apparatus 100, and has a sheet feeding roller 3 to come into contact with the upper surface of the uppermost recording medium S. As the sheet feeding roller 3 is rotated counterclockwise in FIG. 1, the sheet feeding roller 3 feeds the uppermost recording medium S toward the registration roller pair 4.

The transfer belt cleaner 13 of the transfer device 71 includes a cleaning brush and a cleaning blade being disposed opposite and contacting the transfer belt 11. With the cleaning brush and the cleaning blade, the transfer belt cleaner 13 scrapes extraneous matter such as residual toner off the transfer belt 11, thereby removing the extraneous matter from the transfer belt 11. Thus, the transfer belt cleaner 13 cleans the transfer belt 11. The transfer belt cleaner 13 further includes a waste toner conveyer that conveys and discards the residual toner removed from the transfer belt 11.

The image forming apparatus 100 of the present embodiment includes an optical sensor 14 that optically reads a test toner image formed on the transfer belt 11. At a return from turn-on of the main power source or a return from the energy saving mode, image density correction is performed as a startup operation of the image forming device 1 as described below. That is, a Y test toner image, an M test toner image, a C test toner image, and a Bk test toner image are individually formed on the transfer belt 11 and read by the optical sensor 14. A Y toner adhesion amount of the Y test toner image is calculated based on the result of reading the Y test toner image by the optical sensor 14, and a predetermined control parameter that affects the image density of the Y toner image is calculated based on the calculation result so that the Y toner image can have a predetermined density. Similarly, for M, C, and Bk, predetermined control parameters that affect the image densities of the M toner image, C toner image, and Bk toner image are corrected based on the calculation results of the M toner adhesion amount, C toner adhesion amount, and Bk toner adhesion amount so that these toner images can have predetermined image densities.

The energy saving mode is one of operation modes that can be set when the image forming apparatus is powered on. Specifically, in the present embodiment, there are mainly three possible operation modes of the image forming apparatus with the main power source powered on: an image forming mode in which an image forming process is executed; a standby mode in which an instruction to execute an image forming operation is waited for, and an energy saving mode in which power consumption is lower than that in the standby mode. The image forming apparatus shifts from the standby mode to the energy saving mode if no image forming operation is performed for a certain period of time. With a shift to the energy saving mode, the power consumption is decreased, for example, such that power distribution to most devices including the fixing device 200 is stopped and power is supplied only to the parts having the functions of receiving image forming information from the controller 110 (see FIG. 4) and accepting an operation of the operation display unit 80.

The return from turn-on of the main power source or the return from the energy saving mode means that the image forming apparatus enters the standby mode in which an instruction to execute an image forming operation is waited for and an image forming operation can be started or enters the image forming mode.

The image forming apparatus 100 of the present embodiment also performs misregistration correction as a startup operation of the image forming device immediately after turn-on of the main power source or at the return from the energy saving mode. That is, a Y misregistration test toner image, an M misregistration test toner image, a C misregistration test toner image, and a Bk misregistration test toner image are individually formed on the transfer belt 11 and read by the optical sensor 14. Based on the reading results, a skew amount and a misregistration amount are detected, and predetermined misregistration correction parameters such as the inclination of the optical mirror in the optical writing device 8 and the optical writing timing are adjusted to suppress misregistration among superimposed color images and image skew.

Figure 2:
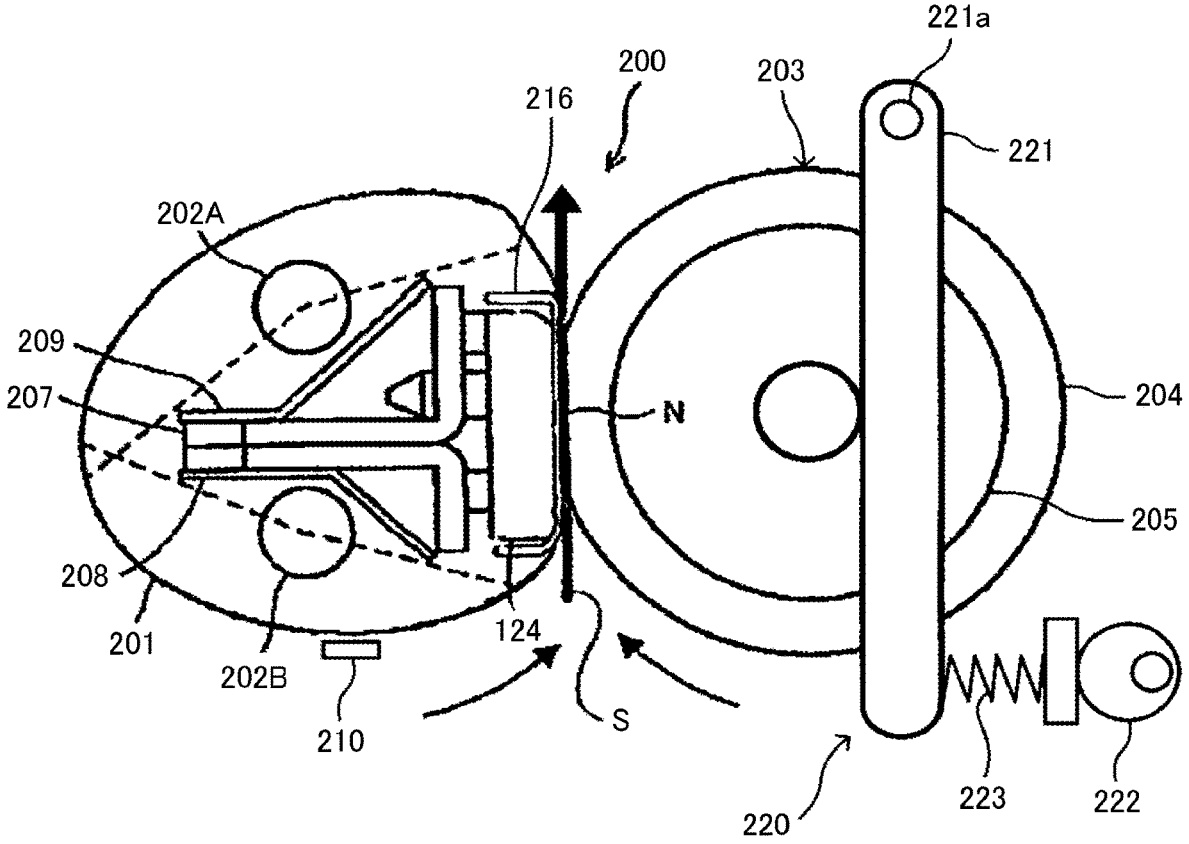
FIG. 2 is a schematic configuration diagram illustrating a fixing device.

FIG. 2 is a schematic configuration diagram illustrating the fixing device 200. The fixing device 200 has: a fixing belt 201 that is a first rotating body and a fixing member; and a pressure roller 203 that is a second rotating body arranged opposite to the rotating belt and is a pressing member. The fixing belt 201 is heated directly by radiant heat from the inner peripheral side by heaters 202A and 202B such as halogen heaters that are heat sources (FIG. 2 illustrates a plurality of heaters, but a single heater may be provided).

At this time, in a loop of the fixing belt 201 of FIG. 2, a nip forming member 124 is disposed to form a fixing nip N with the pressure roller 203 via the fixing belt 201 and indirectly slides over the inner surface of the fixing belt 201 with a thermal conduction aid 216 interposed between the nip forming member 124 and the inner surface of the fixing belt 201. As a recording medium S bearing a toner image T is conveyed through the fixing nip N, the fixing belt 201 and the pressure roller 203 fix the toner image T on the recording medium S under heat and pressure.

With reference to FIG. 2, the thermal conduction aid 216 has a flat shape but may have a concave shape or another shape instead. If the thermal conduction aid 216 contours the fixing nip N into the recess, the recessed fixing nip N directs the leading edge of the sheet P toward the pressure roller 203 as the sheet P is ejected from the fixing nip N, facilitating separation of the sheet P from the fixing belt 201 and suppressing jamming of the sheet P between the fixing belt 201 and the pressure roller 203.

The fixing belt 201 has inside the nip forming member 124 that faces the pressure roller 203, the thermal conduction aid 216 that covers a surface facing inner surfaces of the nip forming member 124 and the fixing belt 201, and a stay member 207 that holds the nip forming member 124 against pressurizing force from the pressure roller 203. Each of the nip forming member 124, thermal conduction aid 216, and the stay member 207 has a length extending in an axial direction of the fixing belt 201 (hereinafter, referred to as "longitudinal direction").

The thermal conduction aid 216 is provided to positively transfer heat in the longitudinal direction and reduce temperature inhomogeneity in the longitudinal direction by suppression of temperature rise at the end portions during continuous sheet feeding.

Therefore, thermal conduction aid 216 is preferably a material capable of transferring heat in a short time, and is preferably a member having high thermal conductivity such as copper, aluminum, or silver. It is preferable that thermal conduction aid 216 is made of copper in a comprehensive view of manufacturing costs, availability, thermal conductivity, and processing.

In the present embodiment, the surface of thermal conduction aid 216 facing the inner surface of the fixing belt 201 is a surface to directly contact the fixing belt 201 and is a nip forming surface.

The fixing belt 201 is an endless belt or film made of a metal material, such as nickel or stainless steel (e.g., steel use stainless or SUS), or a resin material such as polyimide. The fixing belt 201 is constructed of a base layer and a release layer. The release layer, as an outer surface layer of the fixing belt 201, is made of, e.g., perfluoroalkoxy alkane (PFA) or polytetrafluoroethylene (PTFE) to facilitate separation of toner contained in a toner image on a recording medium S from the fixing belt 201. An elastic layer made of silicone rubber or the like may be sandwiched between the base layer and the release layer made of PFA or PTFE. If the fixing belt 201 does not incorporate the elastic layer, the fixing belt 201 has a decreased thermal capacity that improves fixing property of being heated quickly to a desired fixing temperature at which the toner image T is fixed on the recording medium S. However, as the pressure roller 203 and the fixing belt 201 sandwich and press the unfixed toner image T on the recording medium S passing through the fixing nip N, slight surface asperities of the fixing belt 201 may be transferred onto the toner image T on the recording medium S, resulting in variation in gloss of the solid toner image T that may appear as an orange peel image on the recording medium S. To address this circumstance, the elastic layer made of silicone rubber has a thickness not smaller than about 100 micrometers. As the elastic layer made of, e.g., silicone rubber deforms, the elastic layer absorbs the slight surface roughness in the fixing belt 201, thereby reducing formation of the faulty orange-peel image.

The stay member 207 has a shape with an upright portion that is upright on the side opposite to the fixing nip N, the heaters 202A and 202B as fixing heat sources are arranged across the upright portion, and the fixing belt 201 is directly heated from inside by radiant heat of the heaters 202A and 202B.

The fixing belt 201 has inside the stay member 207 as a supporting member for supporting the nip forming member 124 and the fixing nip N, thereby to prevent the nip forming member 124 from being bent under pressure from the pressure roller 203 and obtain an axially uniform nip width. The stay member 207 is held and fixed for positioning at both ends by flanges 208 as holding members. Further, reflection members 209 are provided between the heaters 202A and 202B and the stay member 207 to suppress wasteful energy consumption due to the stay member 207 being heated by radiant heat from the heaters 202A and 202B. Instead of providing the reflection members 209, the surface of the stay member 207 can be heat-insulated or mirror-finished to obtain the same effect.

The pressure roller 203 is constructed of, e.g., a core 205, an elastic rubber layer 204 resting on the core 205, and a surface release layer resting on the elastic rubber layer 204. The release layer, made of PFA or PTFE, facilitates separation of the recording medium S from the pressure roller 203. A driver, such as a motor, is situated inside an image forming apparatus that includes the comparative fixing device 102 or the fixing device 2. A driving force generated by the driver is transmitted to the pressure roller 203 through a gear train, thereby rotating the pressure roller 24. A spring or the like presses the pressure roller 203 against the fixing belt 201, and the elastic rubber layer 204 is compressed and deformed so that the fixing nip N has a predetermined nip width. The pressure roller 203 may be a hollow roller, and the pressure roller 203 may have a heating source such as a heater. The elastic rubber layer 204 may be made of solid rubber, or may be made of sponge rubber when there is no heating source inside the pressure roller 203. The sponge rubber is preferable to the solid rubber because the sponge rubber has enhanced thermal insulation and so draws less heat from the fixing belt 201.

The fixing belt 201 rotates in accordance with rotation of the pressure roller 203. In the case of FIG. 2, the pressure roller 203 is rotated by the drive motor 211 (see FIG. 3), and the fixing belt 201 is rotated by transmitting the driving force to the belt at the fixing nip N. At the fixing nip N, the fixing belt 201 rotates while being sandwiched between the pressure roller 203 and the nip formation pad 206. At a circumferential span of the fixing belt 201 other than the fixing nip N, the fixing belt 201 rotates while opposed axial end portions of the fixing belt 201 are guided by the flanges 208. According to the above configuration, it is possible to achieve a fixing device that is inexpensive and performs a fast fixing startup operation.

Further, the fixing device 200 includes a temperature sensor 210 provided to face the outer peripheral surface of the fixing belt 201. It is more preferable that the temperature sensor 210 is not in contact with the fixing belt 201 because the surface thereof will not be damaged by sliding. A thermopile or a non-contact type thermistor can be used as the non-contact type temperature sensor. Based on the temperature detected by the temperature sensor 210, the heaters 202A and 202B are controlled so that the fixing belt 201 reaches a predetermined temperature.

The fixing device 200 further includes a contact-separation mechanism 220 that causes the pressure roller 203 to contact with and separate from the fixing belt 201. Specifically, the contact-separation mechanism 220 includes a pressure lever 221, an eccentric cam 222, a pressure spring 223, and the like.

The pressure lever 221 is supported by a side plate of the fixing device 200 so as to be rotatable around a support shaft 221*a* provided at one end. The pressure lever 221 has a central portion in contact with a bearing of the pressure roller 203. The bearing of the pressure roller 203 is movably held in an elongated hole formed in the side plate.

The pressure spring 223 is connected to the other end of the pressure lever 221, and the eccentric cam 222 is engaged with a holding plate of the pressure spring 223. The eccentric cam 222 is capable of being rotated by a cam motor 224 (see FIG. 3).

According to such a configuration, the rotation of the eccentric cam 222 causes the pressure lever 221 to rotate around the support shaft 221*a*, so that the pressure roller 203 illustrated in FIG. 2 can take a pressurizing attitude in which to pressurize the fixing belt 201 and a non-pressurizing attitude in which to separate from the fixing belt 201 (or depressurize the fixing belt 201).

During a normal fixing process, the eccentric cam 222 takes an attitude in the rotation direction illustrated in FIG. 2, and the pressure roller 203 takes a pressurizing attitude for pressurizing the fixing belt 201 to form a desired fixing nip. On the other hand, at times other than during the normal fixing process (during handling of a sheet jam, standby of the device, and the like), the attitude of the eccentric cam 222 in the rotation direction is turned by 180° from the state illustrated in FIG. 2, and the pressure roller 203 takes the non-pressurizing attitude.

Figure 3:
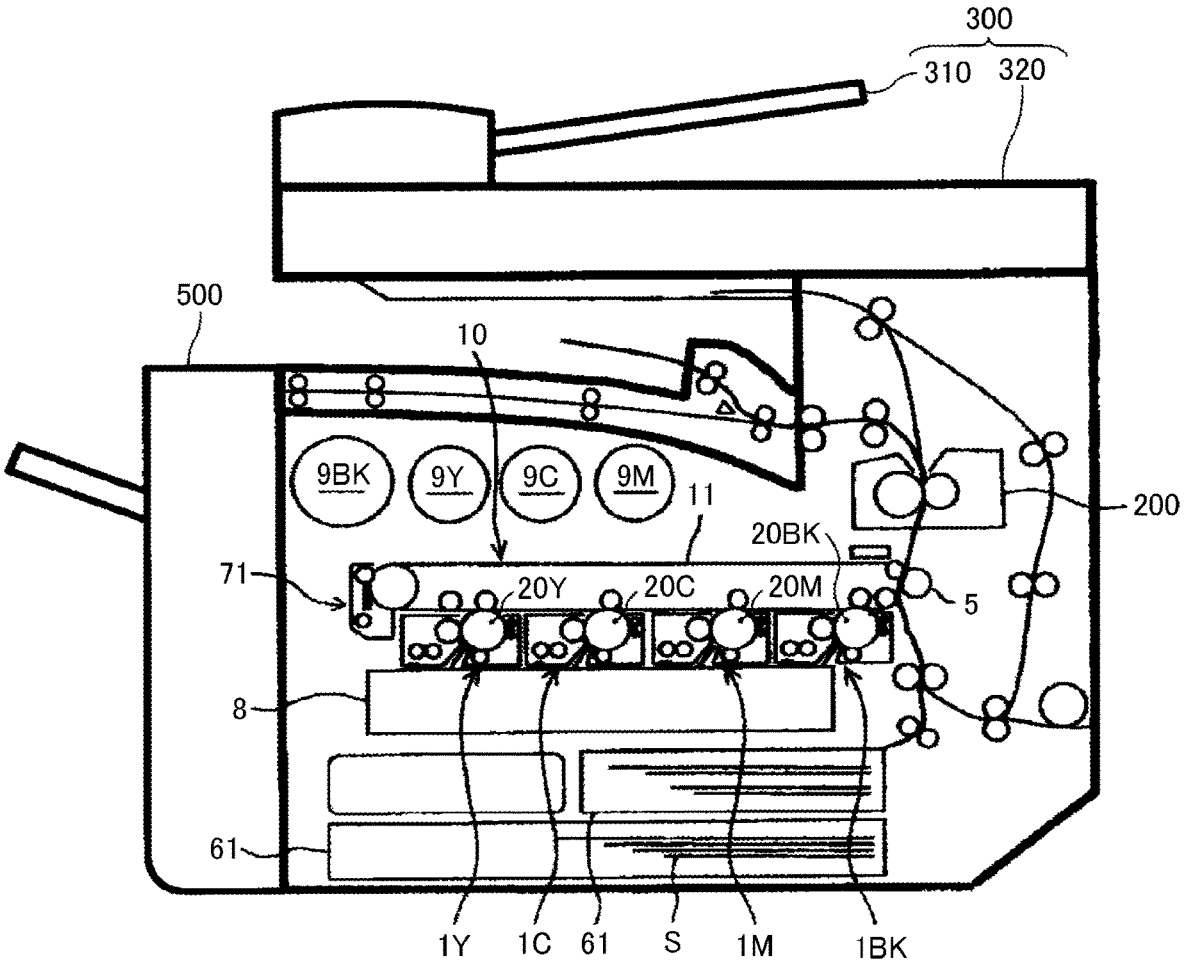
FIG. 3 is a schematic configuration diagram of the image forming apparatus including a post-processing device as a peripheral device and a scanner as a peripheral device.

FIG. 3 is a schematic configuration diagram of the image forming apparatus 100 including a post-processing device 500 as a peripheral device and a scanner 300 as a peripheral device. The post-processing device 500 as a peripheral device performs predetermined post-processing such as binding processing and folding processing on the recording medium S on which an image is formed. The scanner 300 as a peripheral device includes an automatic document feeder (ADF) 310 and an image reading unit 320 that reads an image from a document. The peripheral devices are not limited to them but may include, for example, a cooling device that cools the recording medium whose temperature has risen by the fixing device 200, an image determination device that determines the quality of the image formed on the recording medium, a large-volume sheet feeding device that stores a large quantity of recording medium and feeds the recording medium to the image forming apparatus 100.

The peripheral devices such as the post-processing device 500 and the scanner are connected to the main body of the image forming apparatus 100 and are operated with supply of power and control signals from the image forming apparatus. The image forming apparatus 100 has a peripheral device detection unit to detect the presence or absence of peripheral devices such as the post-processing device 500 and the scanner 300 by an electric means. As illustrated in FIG. 3, the image forming apparatus 100 to which the peripheral devices are connected performs a peripheral device startup operations such as an initializing operation of returning operational parts of the peripheral devices to home positions when the image forming apparatus is powered on or returned from the energy saving mode. For example, in the post-processing device 500 including a stapler as a binding processing device, as the initializing operation, the image forming apparatus 100 checks whether the stapler is at the home position, and if the stapler is not at the home position, returns the stapler the home position. As an example of the initializing operation in the scanner 300, the image forming apparatus 100 checks whether an irradiation unit for applying light to the document surface of a document scanned and set in the main scanning direction of the image reading unit 320 and guiding reflected light to an image element such as CCD is at the home position. When the irradiation unit is not at the home position, the image forming apparatus 100 returns the irradiation unit to the home position. Further, when a large-volume sheet feeding device is connected as a peripheral device, as the startup operation of the large-volume sheet feeding device, the image forming apparatus 100 raises the bottom plate.

Figure 4:
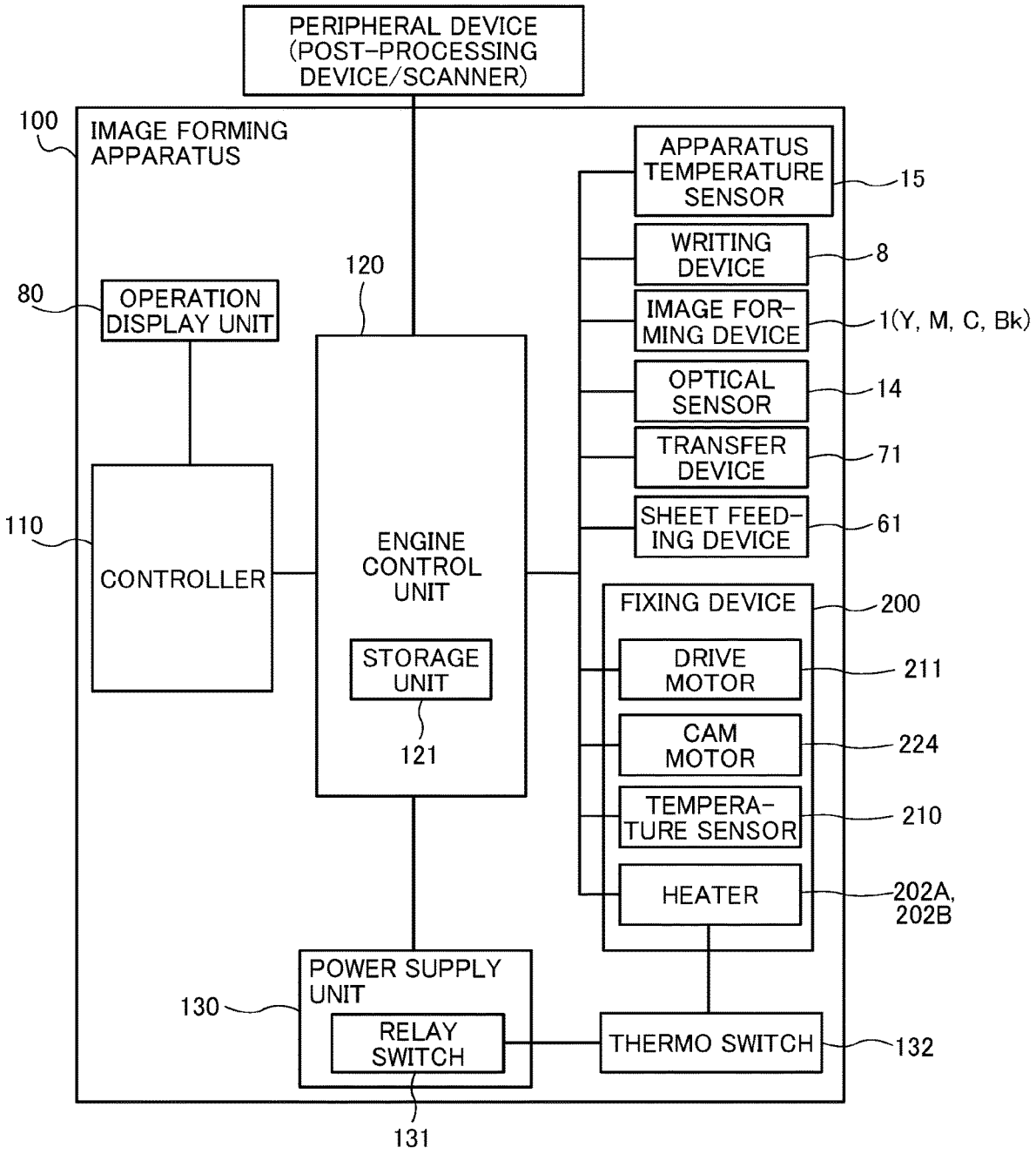
FIG. 4 is a block diagram illustrating main parts of the image forming apparatus.

FIG. 4 is a block diagram illustrating main parts of the image forming apparatus 100. The image forming apparatus 100 includes the controller 110 that controls the entire image forming apparatus 100 and an engine control unit 120 as control circuitry that also serves as a control unit of the fixing device 200 that controls the components of the image forming apparatus 100 (the fixing device 200, the image forming device 1, the transfer device 71, the sheet feeding device 61, etc.). The image forming apparatus 100 also includes the operation display unit 80 that is formed by a touch panel or the like, an apparatus temperature sensor 15 that detects the temperature inside the apparatus, a power supply unit 130 that supplies power to the heaters 202A and 202B of the fixing device, and the like.

The power supply unit 130 includes a relay switch 131. When the relay switch 131 is turned on, power can be supplied to the heaters 202A and 202B. The power supply unit 130 further includes a thermo switch 132 between the relay switch 131 and the heaters 202A and 202B. The thermo switch 132 includes an element whose resistance value decreases as the temperature rises, and a switch that mechanically cuts off the electrical connection when a current more than a specified value flows. Providing thermo switch 132 makes it possible to, for example, when the temperature sensor 210 fails and the fixing belt 201 has an abnormal temperature higher than a specified temperature, activate thermo switch 132 to forcibly cut off power supply to the heaters 202A and 202B. This prevents the fixing belt 201 from reaching an abnormally high temperature.

In the present embodiment, when thermo switch 132 is activated to forcibly cut off the power supply to the heaters 202A and 202B, there is a high possibility that an abnormality has occurred in the fixing device 200. Thus, the image forming apparatus 100 provides an instruction for calling a repairperson on the operation display unit 80 and disables an image forming operation. Further, the image forming apparatus 100 may inform an abnormality in the image forming apparatus to a service company in charge of maintenance of the image forming apparatus 100 via a communication network such as the internet.

The controller 110 plays a role of controlling the engine control unit 120 and provides an image forming command to the engine control unit 120. The engine control unit 120, which is also a control unit of the fixing device, controls parts and components of the image forming apparatus, and peripheral devices to perform image forming based on the image forming command provided from the controller 110. The engine control unit 120 has a storage unit 121. The storage unit 121 stores, for example, the temperature detected by the apparatus temperature sensor 15 at turn-off of the main power source or at switching to the energy saving mode, the time of the startup operation of the controller 110 at turn-on of the main power source, the time of the startup operation of the controller 110 (hereinafter, called controller startup time as appropriate) at a return from the energy saving mode (hereinafter, called mode return time), and the like. In addition, the storage unit 121 also stores the time of the fixing startup operation (hereinafter, called fixing startup time as appropriate) performed by the fixing device 200 at turn-on of the main power source or at a return. The storage unit 121 also stores the time normally required for the peripheral device startup operation (hereinafter, called peripheral device startup time as appropriate) at turn-on of the main power source of the peripheral device connected to the image forming apparatus 100 or at a time of return of the peripheral device, and the time normally required for the image forming device startup operation (hereinafter, called image forming device startup time as appropriate) at turn-on of the power source or return of the image forming device.

As will be described later, the engine control unit 120 delays the start of the fixing startup operation (at the timing for starting the fixing startup operation) based on the controller startup time, the peripheral device startup time, and the image forming device startup time.

When the main power switch of the image forming apparatus is switched from off to on so that the main power source of the image forming apparatus is turned on, or when the image forming apparatus 100 returns from the energy saving mode in response to receipt of an image forming information from a personal computer or the like or an operation performed by the user on the operation display unit 80, the image forming apparatus 100 performs the respective startup operations of the fixing device 200, the controller 110, and the image forming device 1. Further, when a peripheral device is connected, the image forming apparatus 100 also performs the startup operation of the connected peripheral device. As for the peripheral device, the image forming apparatus 100 may not perform the startup operation at a return from the energy saving mode if the image forming information includes no information on the use of the peripheral device, as will be described later.

Figure 5:
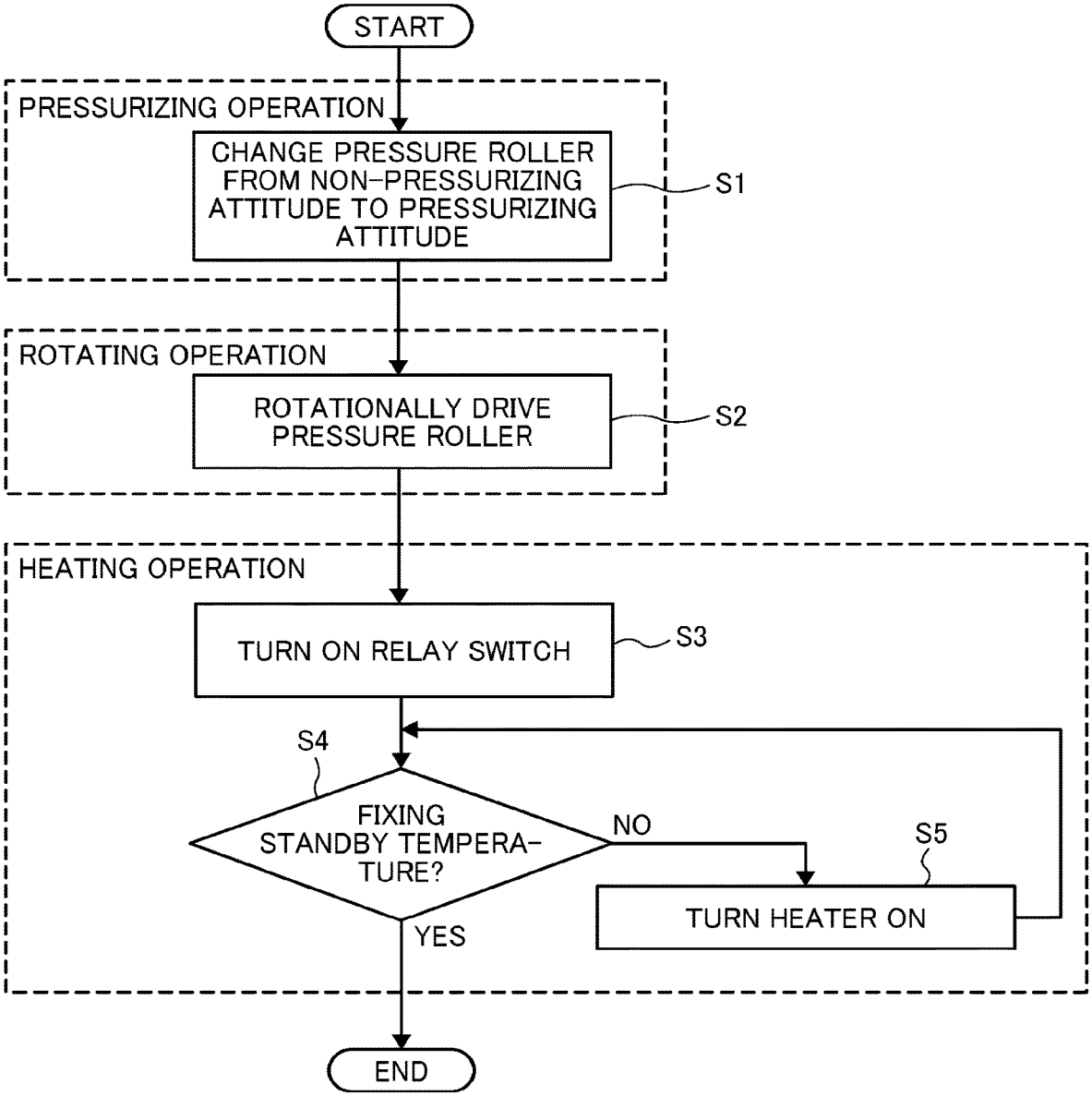
FIG. 5 is a flowchart of a fixing startup operation.

FIG. 5 is a flowchart of the fixing startup operation. As illustrated in FIG. 5, the fixing startup operation includes at least two operations of a rotating operation and a heating operation, and also includes a pressurizing operation when the apparatus has a pressurizing/depressurizing mechanism therein. First, the engine control unit 120 performs a pressurizing operation (when the pressurizing/depressurizing mechanism is provided). When starting the pressurizing operation, the engine control unit 120 drives the cam motor 224 to rotate the eccentric cam 222 by 180° so that the pressure roller 203 in the non-pressurizing attitude is brought into the pressurizing attitude (S1). Next, the engine control unit 120 performs a rotating operation. When starting the rotating operation, the engine control unit 120 drives the drive motor 211 to start the rotational driving of the pressure roller 203 and cause the fixing belt 201 to rotate together with the pressure roller 203 (S2).

After rotationally driving the pressure roller 203, the engine control unit 120 starts the heating operation. First, the engine control unit 120 checks the temperature of the fixing belt 201 by the temperature sensor 210. When the temperature of the fixing belt 201 is equal to or lower than the temperature at which thermo switch 132 activates, the engine control unit 120 turns the relay switch 131 of the power supply unit 130 from off to on so as to be capable of supplying power to the heaters 202A and 202B (S3).

Next, the engine control unit 120 checks the temperature of the fixing belt 201 by the temperature sensor 210 (S4). When the temperature of the fixing belt 201 is lower than a fixing standby temperature (<fixing temperature) (No in S4), the engine control unit 120 controls the power supply unit 130 to supply power to the heaters 202A and 202B so that the heaters 202A and 202B turn on (S5). When the temperature of the fixing belt 201 reaches the fixing standby temperature (Yes in S4), the engine control unit 120 determines that the fixing startup operation is completed, and ends the fixing startup operation.

The fixing standby temperature is a temperature that can be reliably raised to the fixing temperature by the heaters 202A and 202B in a period of time from the start of the image forming operation to the arrival of the recording medium S at the fixing nip N of the fixing device 200. Therefore, the completion of the fixing startup operation means that the fixing device is ready to start the image forming operation immediately.

After the end of the fixing startup operation, the image forming apparatus 100 moves to the fixing standby operation. However, when it is not necessary to wait because the image forming information has been received from the printer, the image forming apparatus 100 may move directly to the image forming mode without passing through the fixing waiting state. In the fixing standby operation, while rotationally driving the pressure roller 203 and causing the fixing belt 201 to rotate together with the pressure roller 203, the image forming apparatus 100 controls the heater 202A and 202B based on the temperature detected by the temperature sensor 210 to keep the fixing belt 201 at the fixing standby temperature.

In the fixing startup operation of the present embodiment, the rotating operation is first performed and then the heating operation is performed. The reason for this is as described below. If the heating operation is started before the rotating operation, the fixing belt 201 may be partly heated and a certain portion of the fixing belt 201 may have an abnormally high temperature. If the fixing belt 201 is rotated in such a state where a part of the fixing belt 201 has an abnormally high temperature, thermo switch 132 may be activated due to the abnormally high-temperature portion of the fixing belt 201 to forcibly cut off the power supply to the heaters 202A and 202B. As described above, when thermo switch 132 is activated, the image forming apparatus provides an instruction for calling a serviceperson on the operation display unit 80 and disables the image forming operation. Therefore, the rotating operation is first started and then the heating operation is performed so that a certain portion of the fixing belt 201 does not have an abnormally high temperature and thermo switch 132 is not activated accordingly.

Further, in the present embodiment, the image forming apparatus 100 includes the relay switch 131 that mechanically turns on/off the power supply to the heaters 202A and 202B, and turns on the relay switch 131 to enable power supply and then controls the power supply to the heaters 202A and 202B by software circuitry (ON/OFF control).

Thus, the provision of the relay switch 131 that mechanically turns on/off the power supply to the heaters 202A and 202B makes it possible to mechanically cut off the connection with the power source. Accordingly, the heaters 202A and 202B can be kept from accidental power supply so that it is possible to reliably prevent thermo switch 132 from being activated due to power supply to the heaters 202A and 202B if the temperature of the fixing belt 201 is equal to or higher than the temperature at which thermo switch 132 would be activated.

In the present embodiment, the heating operation is performed after start of the rotating operation. However, in a fixing device having a large heat capacity, such as a fixing device using a fixing roller and a fixing device in which a fixing belt is stretched by a plurality of stretching rollers, the rotating operation may be performed after the heating operation.

Figure 6A:
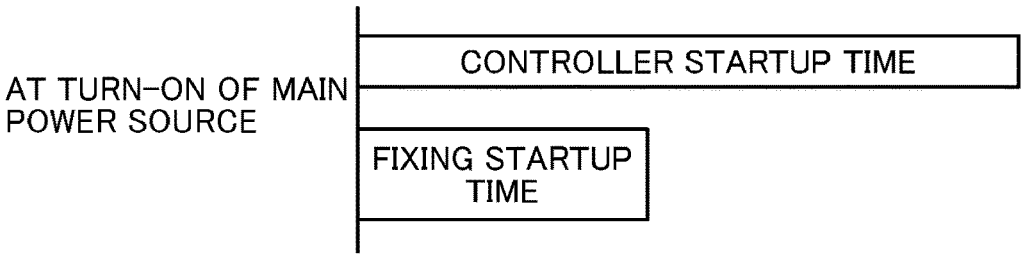
FIGS. 6A and 6B are timing charts illustrating a conventional controller startup operation and a fixing device startup operation.
Figure 6B:
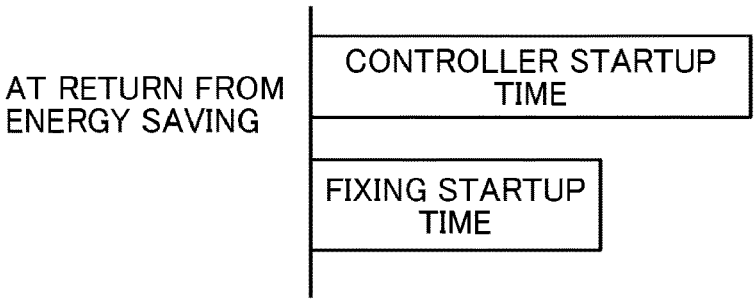

FIG. 6A is a timing chart of a conventional startup operation of the controller 110 and the startup operation of the fixing device 200 at turn-on of main power source, and FIG. 6B is a timing chart of the conventional startup operation of the controller and the startup operation of the fixing device 200 at a return from the energy saving mode. The fixing device 200 of the present embodiment is fast in the fixing startup operation as described above. As illustrated in FIGS. 6A and 6B, it can be seen that the startup time of the fixing device 200 is significantly shorter than the startup time of the controller 110.

Therefore, as illustrated in FIGS. 6A and 6B, if the fixing startup operation is started at the same timing as the startup operation of the controller 110, upon completion of the fixing startup operation, the startup operation of the controller 110 is not yet completed. Thus, the image forming apparatus 100 cannot issue an image forming instruction to the engine control unit 120 so that no image forming can be performed. Therefore, the fixing device 200 is under the fixing standby operation until the startup operation of the controller 110 is completed. In the standby operation until the startup operation of the controller 110 is completed, the fixing belt 201 and the pressure roller 203 continue to rotate unnecessarily. As a result, the wear of the fixing belt 201, the pressure roller 203, and the gear transferring driving force of the drive motor 211 to the pressure roller 203 progresses faster, which raises a possibility that the service life of these components will end early.

Further, in the fixing device 200 including a sliding sheet impregnated with a lubricant such as oil between the nip forming member 124 and the fixing belt 201, the lubricating liquid leaks from the sliding sheet due to sliding with the fixing belt 201. Therefore, due to useless rotation until the startup operation of the controller 110 is completed, the lubricant on the sliding sheet is quickly lost, slidability deteriorates, and the fixing belt 201 becomes difficult to rotate. Since the fixing device 200 causes the fixing belt 201 to be rotated only by rotation of the pressure roller 203, when the sliding resistance of the fixing belt 201 increases, the rotation torque of the pressure roller 203 (more strictly, the frictional force between the fixing belt 201 and the sliding sheet) increases, slipping occurs between the fixing belt 201 and the pressure roller 203, the recording medium S cannot be conveyed, and the service life ends early.

Further, in the standby operation until the startup operation of the controller 110 is completed, ON/OFF control of the heaters 202A and 202B is performed in order to maintain the fixing standby temperature, resulting in unnecessary heating. As a result, useless power consumption and useless heat damage are caused to the fixing belt 201 and the like.

Therefore, in the present embodiment, in order to suppress such unnecessary rotation and unnecessary heating of the fixing device, the start of the fixing startup operation is delayed so that the completion of the fixing startup operation coincides with the completion of the startup operation of the controller 110. Hereinafter, Example 1 will be described specifically.

Example 1

Figure 7:
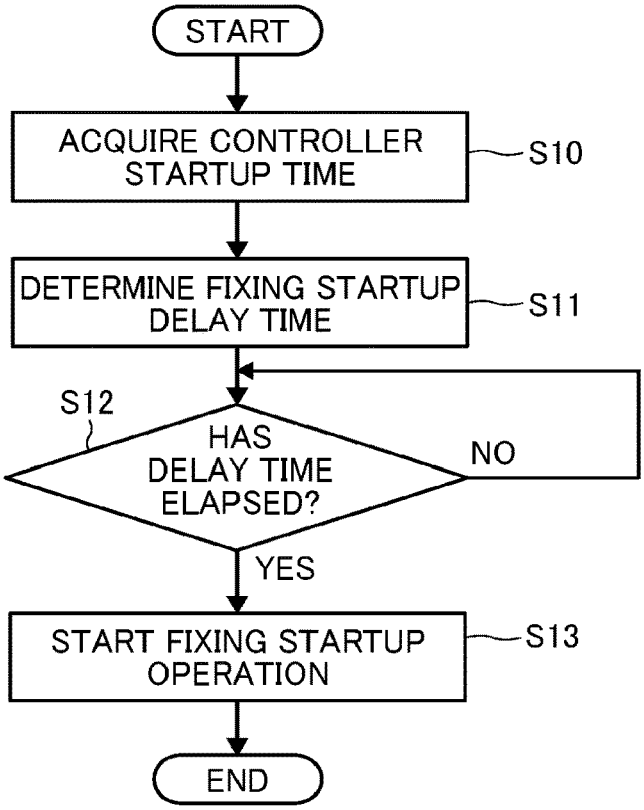
FIG. 7 is a control flowchart of delay control on start of the fixing startup operation according to Example 1.

FIG. 7 is a control flowchart of delay control on start of the fixing startup operation according to Example 1; As illustrated in FIG. 7, the engine control unit 120 acquires the controller startup time stored in the storage unit 121 at turn-on of the main power source or at a return from the energy saving mode (hereinafter, called mode return) (S10). The storage unit 121 stores the controller startup time required for completion of the startup operation of the controller at turn-on of the main power source, and the controller startup time at a mode return. In the energy saving mode, some of the functions of the controller 110 are activated, so the startup time is shorter than at turn-on of the main power source. Thus, the storage unit 121 stores both the controller startup time at turn-on of the main power source and the startup time at a mode return. At turn-on of the main power source, the engine control unit 120 acquires the controller startup time at turn-on of the main power source from the storage unit 121, and at a mode return, the engine control unit 120 acquires the controller startup time at a mode return from the storage unit 121.

Next, the engine control unit 120 determines the fixing startup delay time (S11). Specifically, the engine control unit 120 detects the temperature of the fixing belt 201 by the temperature sensor 210 and calculates the fixing startup time based on the temperature of the fixing belt 201. If the temperature of the fixing belt 201 is high, the fixing belt 201 reaches the fixing standby temperature in a short time, so that the fixing startup time becomes short. On the other hand, if the temperature of the fixing belt 201 is low, it takes time for the fixing belt 201 to reach the fixing standby temperature. Therefore, calculating the fixing startup time based on the temperature of the fixing belt 201 makes it possible to accurately acquire the fixing startup time.

The fixing startup time may be calculated based on the temperature of the fixing belt 201 and the apparatus temperature. If the apparatus temperature is low, the amount of heat radiated from the fixing belt 201 is large, so that the temperature rise of the fixing belt 201 is slowed and the fixing startup time is extended. On the other hand, if the apparatus temperature is high, the amount of heat radiated from the fixing belt 201 is small, so that the temperature of the fixing belt 201 rises quickly and the fixing startup time becomes short. Thus, calculating the fixing startup time based on the temperature of the fixing belt 201 and the apparatus temperature makes it possible to more accurately acquire the fixing startup time.

When acquiring the fixing startup time in this way, the engine control unit 120 subtracts the acquired fixing startup time from the controller startup time obtained from the storage unit 121 to determine the fixing startup delay time.

The engine control unit 120 starts a timer from the start of the startup operation of the controller 110. When the timer reaches the determined fixing startup delay time (Yes in S12), the engine control unit 120 starts the fixing startup operation (S13).

Figure 8A:
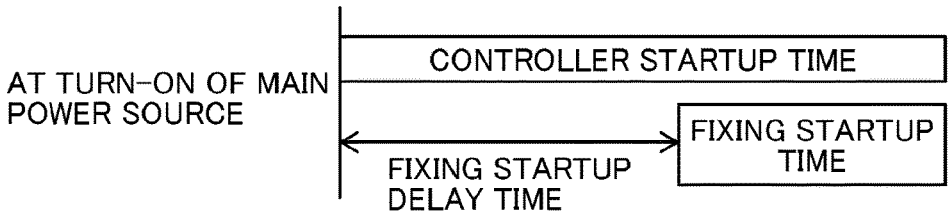
FIGS. 8A and 8B are examples of timing charts illustrating a controller startup operation and a fixing device startup operation in Example 1.
Figure 8B:
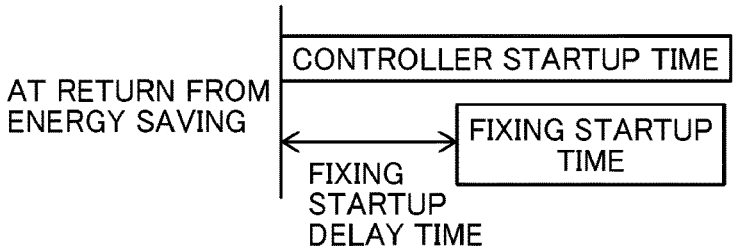

FIG. 8A is an example of a timing chart of the startup operation of the controller 110 and the startup operation of the fixing device 200 at turn-on of the main power source in Example 1, and FIG. 8B is an example of a timing chart of the startup operation of the controller and the startup operation of the fixing device 200 at a return in Example 1. In Example 1, as described above, the fixing startup delay time is determined based on the controller startup time, and the fixing startup operation is performed after a lapse of the determined fixing startup delay time so that the completion of the startup operation of the controller 110 and the completion of the fixing startup operation can coincide with each other as illustrated in FIGS. 8A and 8B. This eliminates the fixing standby operation until the completion of the startup operation of the controller 110, thereby causing no unnecessary rotating operation or unnecessary heating operation. As a result, it is possible to prevent the fixing device 200 from reaching its end of life early.

The startup operation of the controller 110 is an operation for allowing the controller 110 to issue an image forming command to the engine control unit 120. When the startup operation of the controller 110 is completed, the image forming command can be promptly issued to the engine control unit 120 to start the image forming operation. Specifically, when the startup operation of the controller 110 is completed, a home screen or the like is displayed on the operation display unit 80 to accept an input operation from the user. Therefore, when the operation display unit 80 is ready to accept an input operation from the user, it can be recognized that the startup operation of the controller 110 is completed.

The completion of the fixing startup operation (the temperature of the fixing belt 201 reaches the fixing standby temperature) and the completion of the startup operation of the controller 110 (the operation display unit 80 becomes ready to accept an input operation from the user) do not need to perfectly coincide with each other but there is no particular problem with a time difference of four to five seconds. Therefore, if the time difference between the completion of the fixing startup operation and the completion of the startup operation of the controller 110 is five seconds or less, it can be said that the completion of the fixing startup operation and the completion of the startup operation of the controller 110 coincide with each other.

Next, Example 2 will be described.

Example 2

Figure 9A:
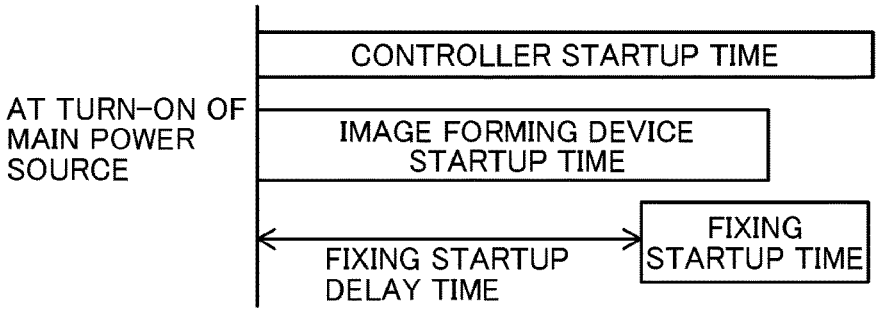
FIGS. 9A and 9B are examples of timing charts of a controller startup operation, an image forming device startup operation, and a fixing startup operation in Example 2.
Figure 9B:
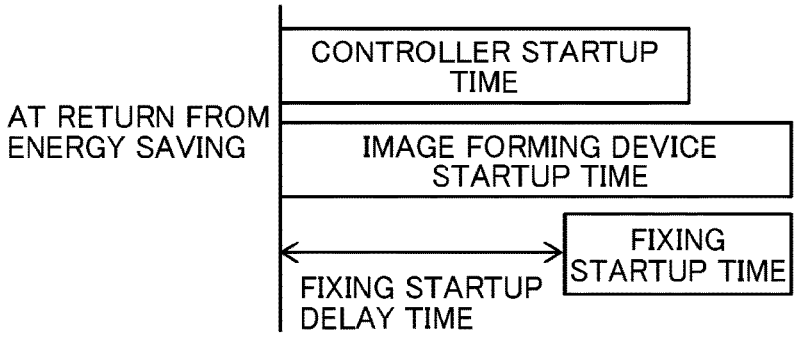
Figure 10:
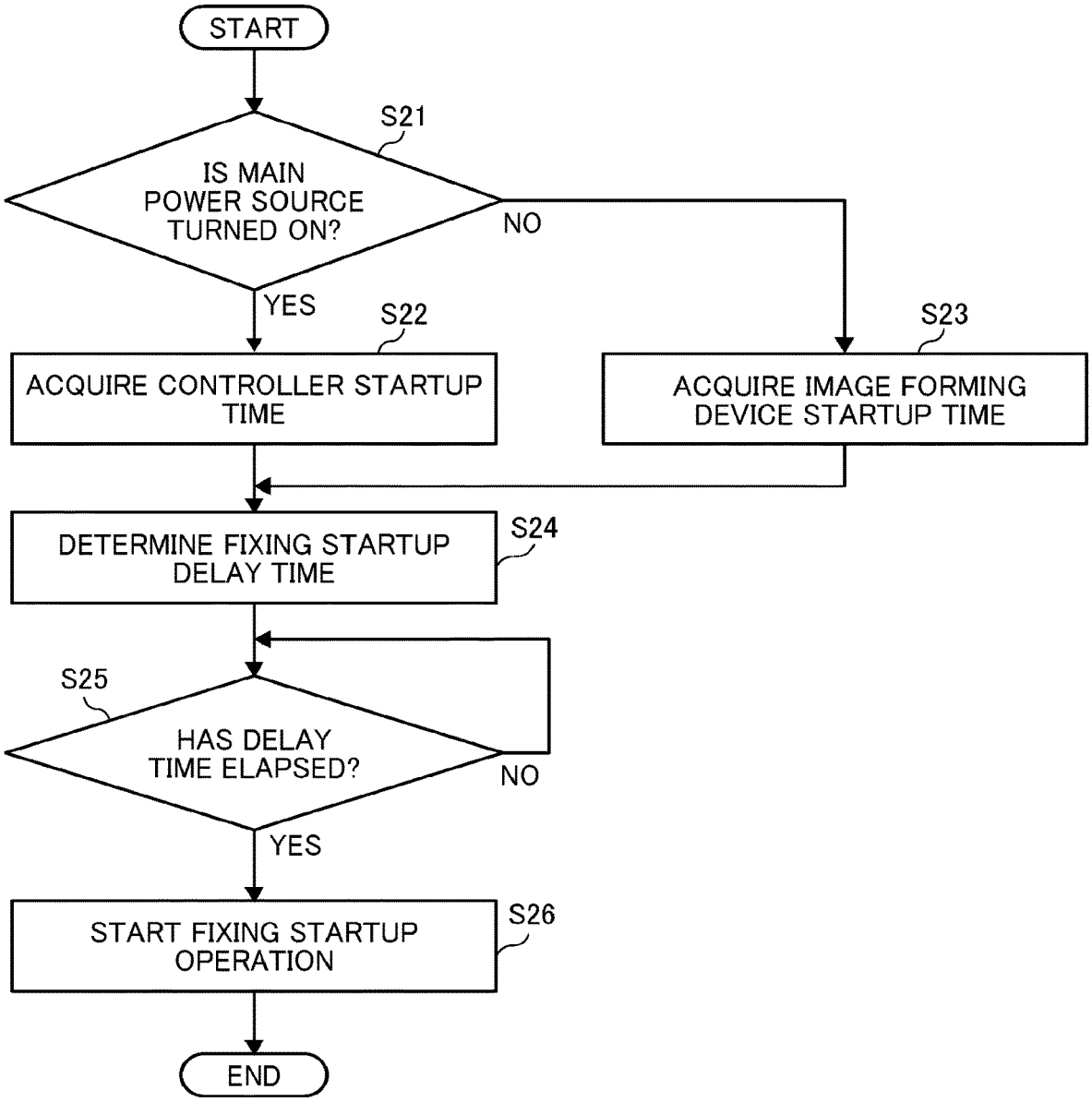
FIG. 10 is a control flowchart of delay control on start of the fixing startup operation according to Example 2.

FIGS. 9A and 9B are timing charts of a controller startup operation, an image forming device startup operation, and a fixing startup operation in Example 2. FIG. 9A is a timing chart at turn-on of a main power, and FIG. 9B is a timing chart at a return from an energy saving mode. FIG. 10 is a control flowchart of delay control on start of the fixing startup operation in Example 2.

As illustrated in FIGS. 9A and 9B in the apparatus configuration, at turn-on of the power source, the controller startup time is longer than the image forming device startup time, but at a return from the energy saving mode, the image forming device startup time may be longer than the controller startup time. Even when the controller startup is completed and the engine control unit 120 is instructed to form an image, the image formation is not started unless the startup operation of the image forming device 1 is not completed. Therefore, in the configuration in which the start of the fixing startup operation is delayed so that the completion of the fixing operation coincides only with the completion of the startup operation of the controller as in Example 1, a useless fixing standby operation occurs until the image forming device startup operation is completed at a return from the energy saving mode.

Thus, in Example 2, the completion of the fixing startup operation is adjusted to coincide with one of the startup operation of the image forming device and the startup operation of the controller, which is later in completion.

Specifically, as illustrated in FIG. 10, at turn-on of the main power source (Yes in S21), the engine control unit 120 acquires the controller startup time from a storage unit 121 (S22), and subtracts the acquired fixing startup time from the controller startup time to determine the fixing startup delay time by (S24). On the other hand, at a mode return (No in S21), the engine control unit 120 acquires the image forming device startup time stored in advance in the storage unit 121 (S23), and subtracts the acquired fixing startup time acquired in the same manner as in Example 1 from the image forming device startup time to determine the fixing startup delay time by (S24).

Then, when the timer started at startup of the controller reaches the determined fixing startup delay time (Yes in S25), the engine control unit 120 starts the fixing startup operation (S26).

Accordingly, as illustrated in FIG. 9A, at turn-on of the main power source, the fixing startup operation is completed in time with the completion of the startup operation of the controller. On the other hand, at a mode return, the fixing startup operation is completed in time with the completion of the startup operation of the image forming device. As a result, it is possible to prevent unnecessary fixing standby operation from occurring both at turn-on of the main power source and at a mode return.

Unlike the example illustrated in FIGS. 9A and 9B, even in an apparatus in which the image forming device startup time at a mode return is shorter than the controller startup time, the image forming device startup time may be longer than the controller startup time depending on the apparatus status.

The image forming device startup operation includes image density correction and misregistration correction as described above. However, as described below, the image forming device startup operation may include toner concentration adjustment to change toner concentration of a developer in the developing device before the image density correction and the misregistration correction, depending on the status of the apparatus. As a result, the startup time of the image forming device may be longer depending on the status of the apparatus, and the startup time of the image forming device may be longer than the controller startup time.

The toner concentration adjustment is added to the image forming device startup operation in the following cases. That is, in the present embodiment, the apparatus temperature detected by the apparatus temperature sensor 15 is stored in the storage unit 121 at turn-off of the main power source or at switching to the energy saving mode. At turn-on of the main power source or at a return from the energy saving mode, the engine control unit 120 detects the apparatus temperature by the apparatus temperature sensor 15, and compares it with the apparatus temperature at turn-off of the main power source or at switching to the energy saving mode stored in the storage unit 121. When the difference between the temperatures is more than a specified value, the toner concentration adjustment of the developer in the developing device is added to the image forming device startup operation.

In the toner concentration adjustment of the developer in the developing device, to increase the toner concentration in the developing device, the toner is supplied to the developing device. On the other hand, to decrease the toner concentration, a pattern toner image is formed on the photoconductor, and the toner in the developing device is consumed. Since the image density correction and the misregistration correction described above are performed after such toner concentration adjustment, the image forming device startup time becomes longer than the controller startup time.

Further, in the image density correction, when the detected image density is significantly deviated from a specified value, the image density correction is performed again after correcting a control parameter affecting the image density. Due to the retry of the image density correction, the startup time of the image forming device becomes longer than the startup time of the controller 110. Further, if the amount of misregistration detected in the misregistration correction is large, the misregistration correction is performed again after adjusting a predetermined misregistration correction parameter. Due to the retry of the misregistration correction, the startup time of the image forming device becomes longer than the startup time of the controller 110.

Therefore, it is preferable to determine the fixing startup delay time according to the change of the completion timing of the image forming device startup operation. Hereinafter, a modification of Example 2 will be described.

Figure 11:
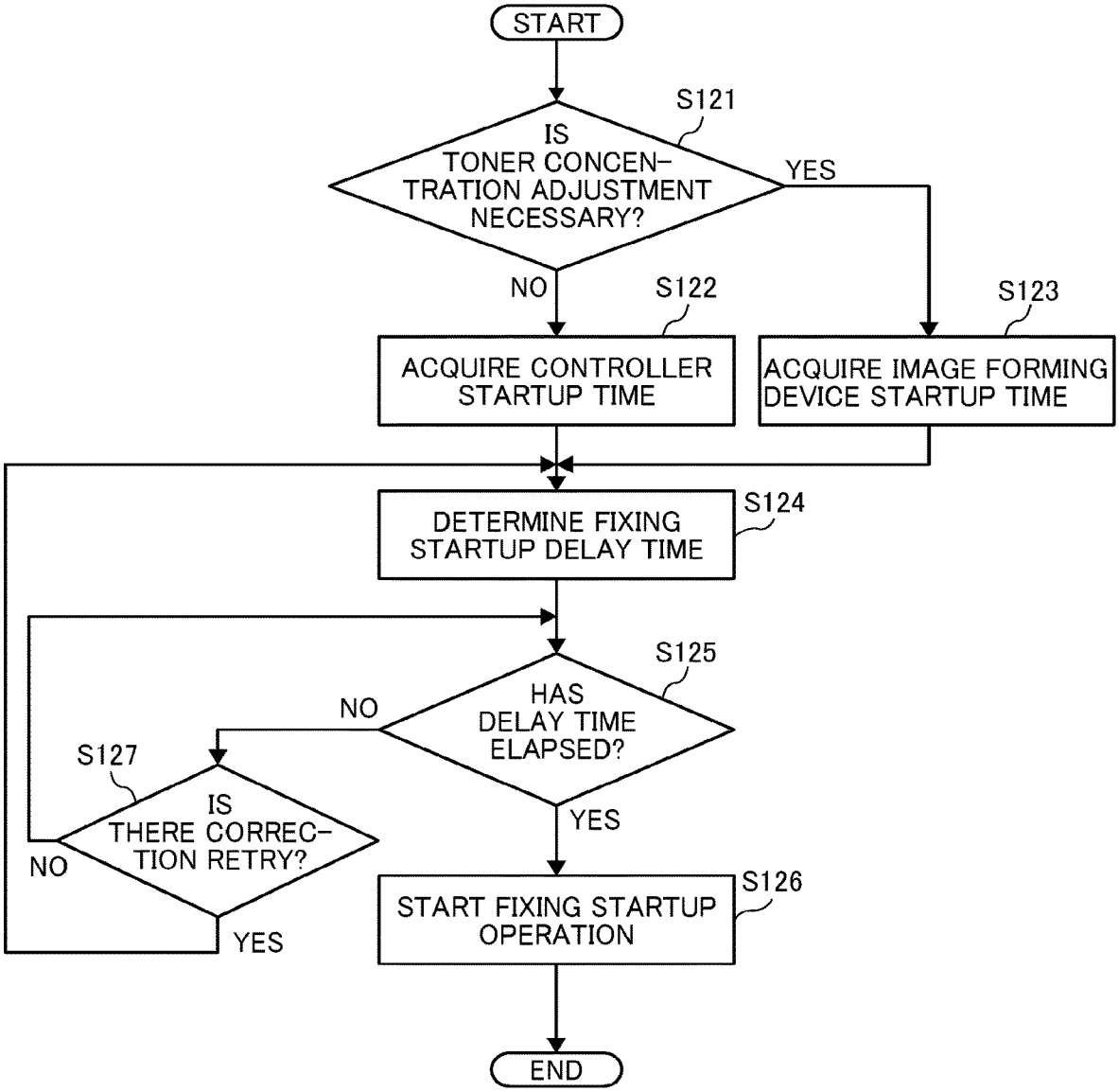
FIG. 11 is a control flowchart of delay control on start of the fixing startup operation according to a modification of Example 2.

FIG. 11 is a control flowchart of delay control on start of the fixing startup operation according to a modification of Example 2. First, the engine control unit 120 checks whether to add the toner concentration adjustment to the image forming device startup operation (S121). When the difference between the current apparatus temperature and the apparatus temperature at turn-off of the main power or at a shift to the energy saving mode is equal to or less than a specified value and thus no toner concentration adjustment is necessary (No in S121), the toner concentration adjustment is not added to the image forming device startup operation. In this case, therefore, the controller startup time is longer than the image forming device startup time (see FIG. 12A), the engine control unit 120 acquires the controller startup time from the storage unit 121 (S122).

On the other hand, when the difference between the current apparatus temperature and the apparatus temperature at turn-off of the main power source or at a shift to the energy saving mode exceeds a specified value and thus the toner concentration adjustment is necessary (No in S121), the toner density adjustment is added to the image forming device startup operation. As a result, the image forming device startup time becomes longer than the controller startup time (see FIG. 12B). In this case, therefore, the image forming device startup time is acquired (S123).

The storage unit 121 of the engine control unit 120 stores in advance a toner concentration adjustment time, an image density correction time, a misregistration correction time, and an image forming device startup time under normal circumstances without the toner concentration adjustment, the image density correction retry, and the misregistration correction retry. When the toner concentration adjustment is required, the toner concentration adjustment time and the normal image forming device startup time are read from the storage unit 121, and these are added up to obtain the image forming device startup time.

Next, the engine control unit 120 acquires the fixing startup time and determines the fixing delay time as in Example 1 (S124). When having acquired the controller startup time, the engine control unit 120 subtracts the fixing startup time from the controller startup time to determine the fixing startup delay time. On the other hand, when the image forming device startup time has been acquired, the engine control unit 120 subtracts the fixing startup time from the image forming device startup time to determine the fixing startup delay time.

Before the timer reaches the determined fixing startup delay time, if the detected image density of the test toner image differs from the target image density by a specified value or more and the engine control unit 120 determines that it is necessary to retry image density correction or retry misregistration correction to a misregistration of a specified value or more (Yes in S127), the engine control unit 120 redetermines the delay time of the fixing startup operation (S124).

To redetermine the fixing startup delay time, the engine control unit 120 acquires the correction time for correction control of the retry from the storage unit 121. To retry only the image density correction, the engine control unit 120 acquires only the image density correction time from the storage unit 121. To retry only the misregistration correction, the engine control unit 120 acquires only the misregistration correction time from the storage unit 121. On the other hand, to retry both the misregistration correction and the image density correction, the engine control unit 120 acquires both the misregistration correction time and the image density correction time from the storage unit 121.

When the fixing startup delay time has been determined based on the controller startup time, the engine control unit 120 acquires the normal image forming device startup time from the storage unit 121, and adds the acquired correction time to the acquired normal image forming device startup time, thereby to acquire the image forming device startup time. Then, the engine control unit 120 subtracts the fixing startup time from the acquired image forming device startup time to reset the fixing startup operation delay time (extends the delay time of the fixing startup operation) (see FIG. 12C).

Figure 12A:
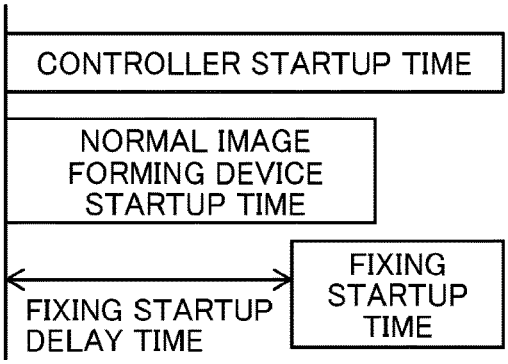
FIGS. 12A to 12D are examples of timing charts of a controller startup operation, an image forming device startup operation, and a fixing startup operation in the modification of Example 2.
Figure 12B:
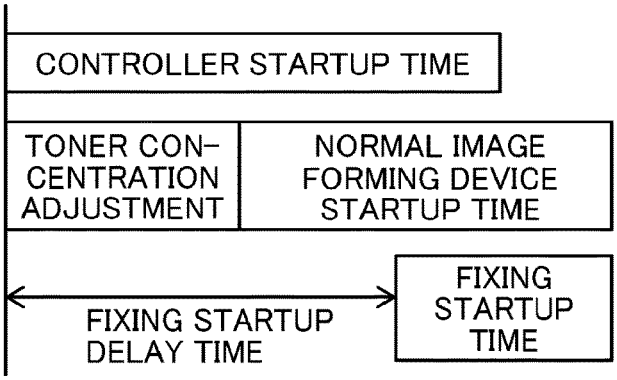
Figure 12C:
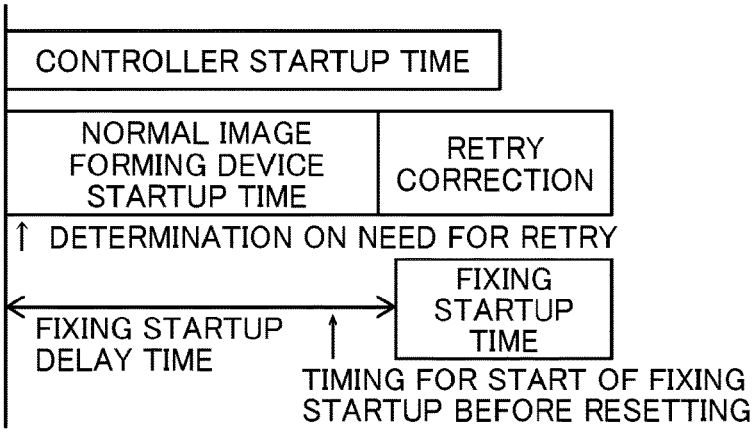
Figure 12D:
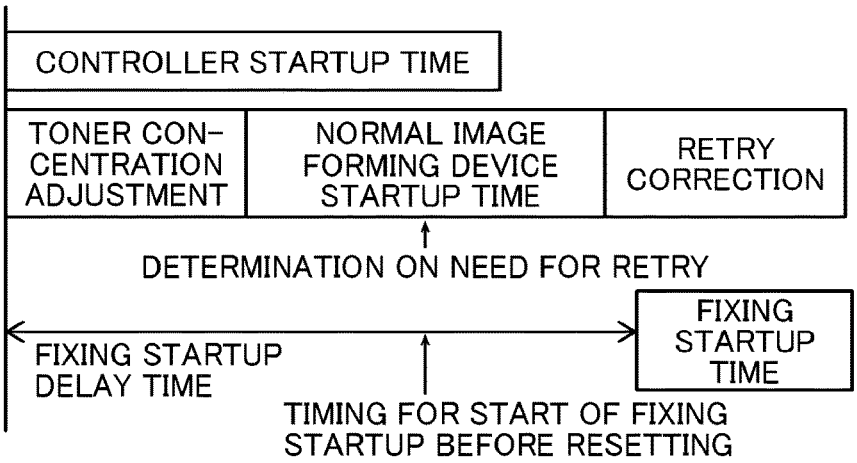

On the other hand, when the fixing startup delay time has been determined based on the image forming device startup time, the engine control unit 120 adds the acquired correction time to the fixing startup delay time to reset the fixing startup delay time (extends the fixing startup delay time) (see FIG. 12D).

When the timer reaches the fixing startup delay time (Yes in S125), the engine control unit 120 starts the fixing startup operation (S126).

FIGS. 12A to 12D are examples of timing charts of an image forming device startup operation, a controller startup operation, and a fixing startup operation in the modification of Example 2. FIG. 12A is an example of a timing chart at a normal image forming device startup operation, and FIG. 12B is a timing chart of the image forming device startup operation to which toner concentration adjustment is added. FIG. 12C is a timing chart of the image forming device startup operation in which a correction retry occurs. FIG. 12D is an example of a timing chart of the image forming device startup operation to which toner concentration adjustment and a correction retry are added.

Also in the modification of Example 2, the start of the fixing startup operation is delayed so that the completion of the fixing startup operation coincides with one of the controller startup operation and the image forming device startup operation, which is longer in startup time. Thus, as illustrated in FIG. 12A, when the controller startup time is longer than the image forming device startup time, the completion of the fixing startup operation can coincide with the completion of the controller startup operation. This eliminates the fixing standby operation until the completion of the startup operation of the controller 110, thereby causing no unnecessary rotating operation or unnecessary heating operation.

Further, as illustrated in FIG. 12B, when the image forming device startup time is longer than the controller startup time, the completion of the fixing startup operation can coincide with the completion of the image forming device startup operation. This eliminates the fixing standby operation until the completion of the startup operation of the image forming device, thereby causing no unnecessary rotating operation or unnecessary heating operation.

As such, even if the toner concentration adjustment is added to the startup operation of the image forming device depending on the status of the apparatus so that the startup operation of the image forming device becomes longer than the normal startup time, the fixing device does not need to perform an unnecessary standby operation but can extend its lifetime.

Further, in an apparatus in which the controller startup time at a mode return illustrated in FIGS. 9A and 9B is shorter than the normal image forming device startup time, when no toner concentration adjustment is added at a mode return, the fixing startup delay time can be determined based on the normal image forming device startup time, and when toner concentration adjustment is added at a mode return, the fixing startup delay time can be determined based on the image forming device startup time in which the toner concentration adjustment time is added to the normal image forming device startup time.

The image forming device startup time may fluctuate depending on various factors, but the controller startup time does not fluctuate. Therefore, as in Example 1, calculating the fixing startup delay time based on the controller startup time that does not fluctuate provides the advantage that the control is easier than in the modification of Example 2. Similarly, as illustrated in FIGS. 9 and 10, determining the fixing startup delay time based on the normal image forming device startup time and the controller startup time without taking into account the factors in fluctuation of the image forming device startup time also provides the advantage that the control is easier than in the modification of Example 2. Further, the addition of toner concentration adjustment and the retry of correction do not frequently take place, and thus the lifetime of the fixing device can be sufficiently extended by the controls illustrated in FIGS. 9 and 10.

Example 3

Figure 13A:
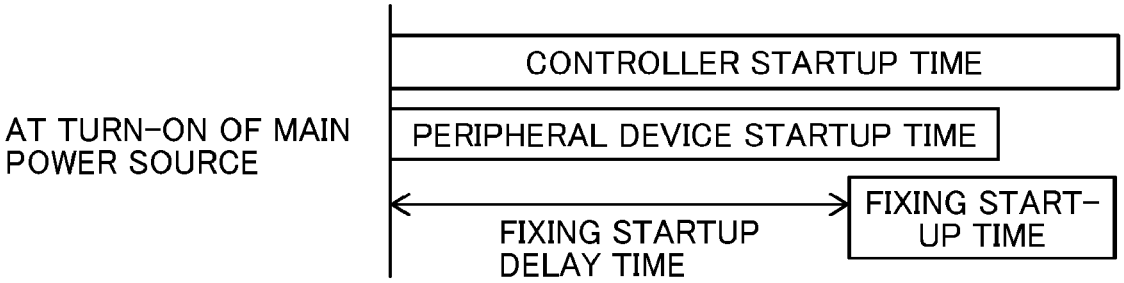
FIGS. 13A and 13B are timing charts of a controller startup operation, a peripheral device startup operation, and a fixing startup operation in Example 3.
Figure 13B:
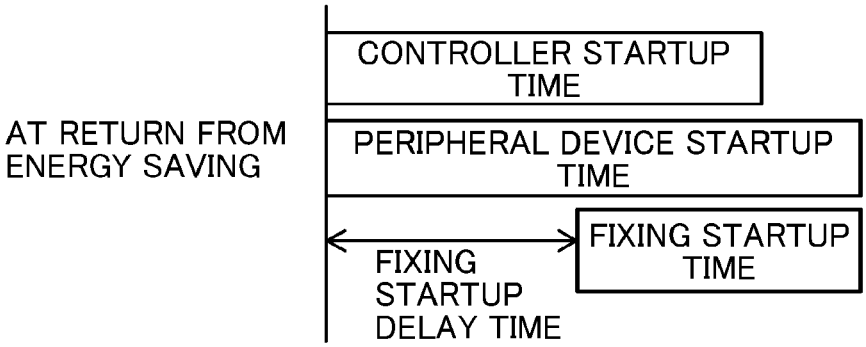
Figure 14:
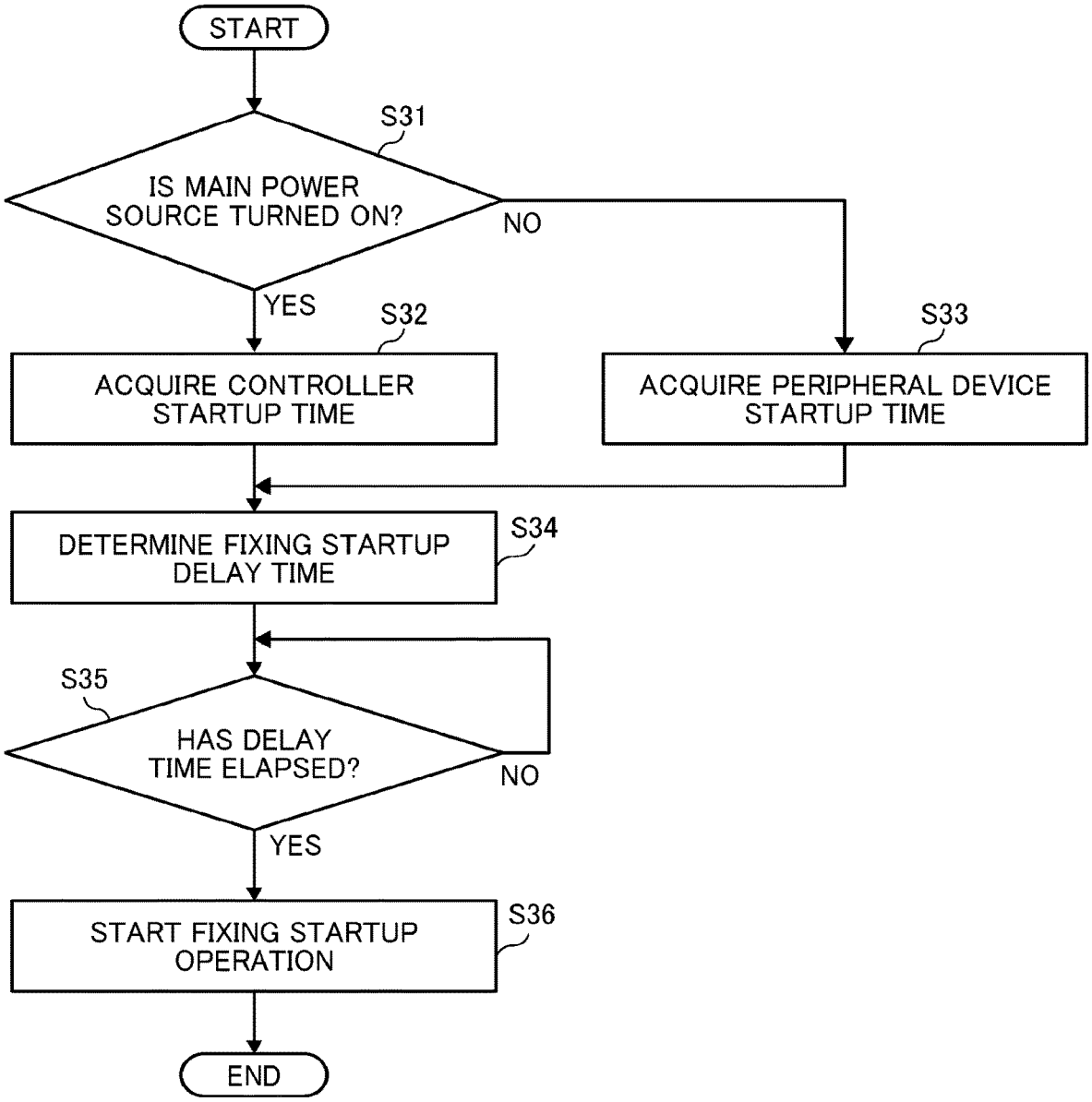
FIG. 14 is a control flowchart of delay control on start of the fixing startup operation in Example 3.

FIGS. 13A and 13B are timing charts of a controller startup operation, a peripheral device startup operation, and a fixing startup operation in Example 3. FIG. 13A is a timing chart at turn-on of the main power source, and FIG. 13B is a timing chart at a return from an energy saving mode (at a mode return). FIG. 14 is a control flowchart of delay control on start of the fixing startup operation in Example 3.

In an image forming apparatus illustrated in FIG. 3 to which peripheral devices such as a scanner 300 and a post-processing device 500 are connected, the peripheral device startup operation is performed at turn-on of the main power or at the mode return. As illustrated in FIGS. 13A and 13B, depending on the connected peripheral devices, the controller startup time may be longer than the peripheral device startup time at turn-on of the power source, but the peripheral device startup time may become longer than the controller startup time at a return from the energy saving mode (at a mode return). Even when the controller startup is completed and the engine control unit 120 is instructed to form an image, the image formation is not started unless the startup operation of the peripheral device used is not completed. Therefore, in the configuration in which the start of the fixing startup operation is delayed so that the completion of the fixing operation coincides only with the completion of the startup operation of the controller as in Example 1, a useless fixing standby state occurs until the peripheral device startup operation is completed at a mode return.

Thus, in Example 3, the completion of the fixing startup operation is adjusted to coincide with one of the startup operation of the peripheral device and the startup operation of the controller, which is later in completion.

Specifically, as illustrated in FIG. 14, at turn-on of the power source (Yes in S31), the engine control unit 120 acquires the controller startup time from a storage unit 121 (S32), and subtracts the acquired fixing startup time from the controller startup time as in Example 1 to determine the fixing startup delay time (S34). On the other hand, at a return from the energy saving mode (No in S31), the engine control unit 120 acquires the peripheral device startup time stored in the storage unit 121 (S33), and subtracts the acquired fixing startup time from the peripheral device startup time to determine the fixing startup delay time (S34). When any peripheral device is connected, the peripheral device startup time is transmitted from the peripheral device to the image forming apparatus, and the peripheral device startup time received from the peripheral device is stored in the storage unit 121. Alternatively, the startup time of the peripheral device connectable to the image forming apparatus may be stored in the storage unit 121 in advance.

Then, when the timer started at startup of the controller reaches the determined fixing startup operation delay time (Yes in S35), the engine control unit 120 starts the fixing startup operation (S36).

Accordingly, as illustrated in FIG. 13A, at turn-on of the power source, the fixing startup operation is completed in time with the completion of the startup operation of the controller. On the other hand, at a return from the energy saving mode, the fixing startup operation is completed in time with the completion of the startup operation of the peripheral device. As a result, it is possible to prevent an unnecessary fixing standby state from occurring both at turn-on of the power source and at a return from the energy saving mode.

The peripheral device startup operation includes an initializing operation. In the initializing operation, when any operating part is not in its home position, an additional control is performed to return the operating part to the home position so that the peripheral device startup time may be extended and the timing for completion of the peripheral device startup operation may be changed. In addition, no peripheral device may be used. In this case, the image forming operation is performed without waiting for the completion of startup of any peripheral device, so that it may not be necessary to coincide the completion of the fixing operation with the completion of any peripheral device. As such, the optimum fixing startup delay time may differ depending on the status of the apparatus such as the necessity of using a peripheral machine and the status of peripheral devices. Therefore, it is preferable to determine the fixing startup delay time in consideration of such status of the apparatus and peripheral devices. Hereinafter, a modification of Example 3 will be specifically described.

Figure 15:
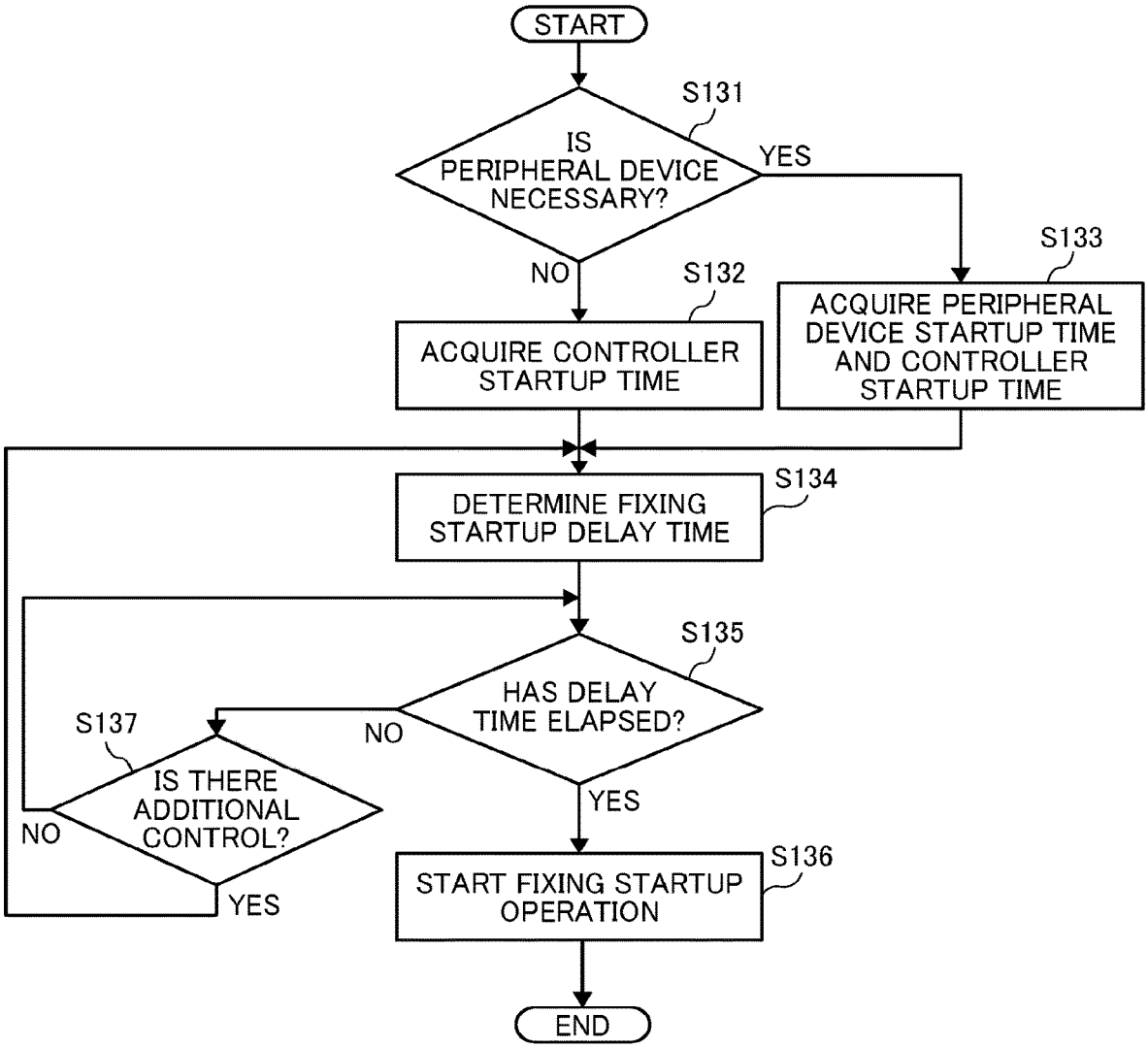
FIG. 15 is a control flowchart of delay control on start of the fixing startup operation at a return according to a modification of Example 3.

FIG. 15 is a control flowchart of delay control on start of the fixing startup operation at a mode return according to a modification of Example 3. The image forming apparatus returns from the energy saving mode upon receipt of image forming information from an external device such as a personal computer (PC). This image forming information includes image data, information such as which sheet feed tray is to be used and whether a peripheral device is to be used. Therefore, first, the engine control unit 120 checks whether the received image formation information includes information indicating the use of a peripheral device (S131).

When the peripheral device is not to be used (No in S131), it is not necessary to start any peripheral device, so that no peripheral device startup operation will be performed. Even if any peripheral device startup operation is to be performed, it is not necessary for the image forming to wait for the peripheral device startup operation. Therefore, at this time, as in Example 1 described above, the engine control unit 120 delays the start of the fixing startup operation so that the completion of the fixing startup operation coincides with the completion of the startup of the controller (see FIG. 16A). That is, the engine control unit 120 acquires only the controller startup time from the storage unit 121 (S132), subtracts the acquired fixing startup time from the controller startup time to determine the fixing startup delay time (S134), and after a lapse of the delay time (Yes in S135), starts the fixing startup operation (S136).

On the other hand, when any peripheral device is to be used (Yes in S131), the engine control unit 120 acquires the startup time of the used peripheral device and the controller startup time stored in the storage unit 121 (S133).

When a plurality of peripheral devices is connected to the image forming apparatus, some peripheral device startup times are shorter than the controller startup time and others are longer than the controller startup time. Therefore, the engine control unit 120 acquires the startup time of the peripheral device to be used and the startup time of the controller, and selects one of the acquired startup time of the peripheral device and the startup time of the controller, which is longer. Then, the engine control unit 120 subtracts the acquired fixing startup time from the selected time to determine the fixing startup delay time. Specifically, if the peripheral device startup time is longer than the controller startup time, the engine control unit 120 selects the peripheral device startup time and subtracts the fixing startup time from the peripheral device startup time to determine the fixing startup delay time (see FIG. 16B). On the other hand, if the controller startup time is longer than the peripheral device startup time, the engine control unit 120 selects the controller startup time and subtracts the fixing startup time from the controller startup time to determine the fixing startup delay time (see FIG. 16C).

Before the timer reaches the determined fixing startup delay time, if, in the startup operation of the peripheral device, an operational part is not in its home position and an additional control such as returning the operational part to the home position is inserted (No in S135, Yes in S137), the engine control unit 120 redetermines the fixing startup delay time (S134).

Specifically, the engine control unit 120 acquires an additional control time. The additional control time may be received from the peripheral device when the peripheral device is connected, stored in advance in the storage unit 121, and acquired later from the storage unit 121. Further, a predetermined uniform time may be used as the additional control time.

If having determined the fixing startup delay time based on the controller startup time, the engine control unit 120 adds the additional control time to the peripheral device startup time, and determines whether the peripheral device startup time including the additional control time is longer than the controller startup time. If the peripheral device startup time including the additional control time is longer than the controller startup time, the engine control unit 120 subtracts the fixing startup time from the peripheral device startup time including the additional control time to reset the delay time of the fixing startup operation (extends the delay time of the fixing startup operation) (see FIG. 16D). On the other hand, when the peripheral device startup time including the additional control time is shorter than the controller startup time, the engine control unit 120 maintains the firstly determined delay time of the fixing startup operation.

On the other hand, when the fixing startup operation delay time has been determined based on the peripheral device startup time, the engine control unit 120 adds the acquired correction time to the delay time of the fixing startup operation to reset the delay time of the fixing startup operation (extends the delay time of the fixing startup operation).

Then, when the timer reaches the delay time of the fixing startup operation (Yes in S135), the engine control unit 120 starts the fixing startup operation (S136).

Figure 16A:
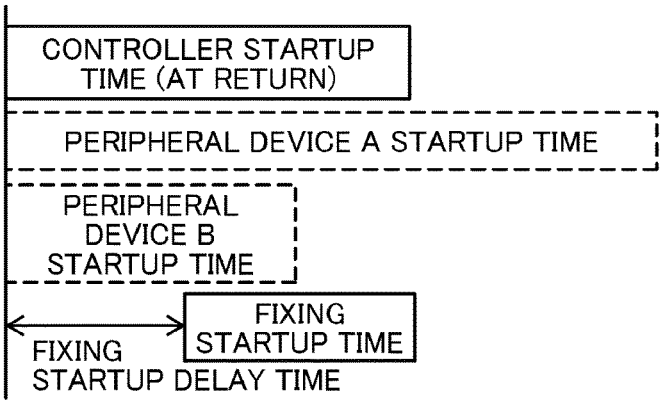
FIGS. 16A to 16D are examples of timing charts of a peripheral device startup operation, a controller startup operation at a return, and a fixing startup operation in the modification of Example 3.
Figure 16B:
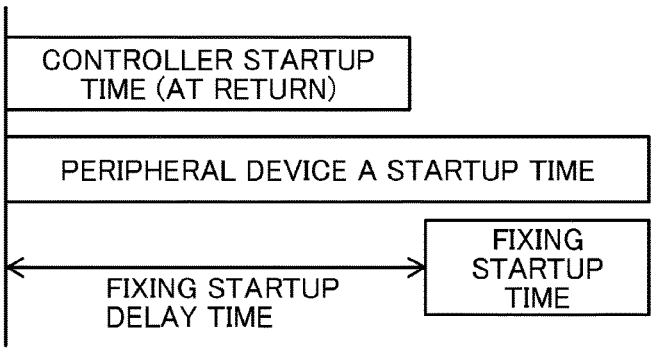
Figure 16C:
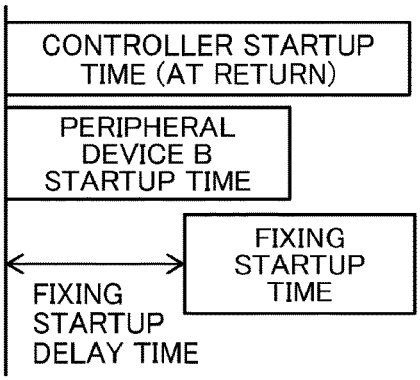
Figure 16D:
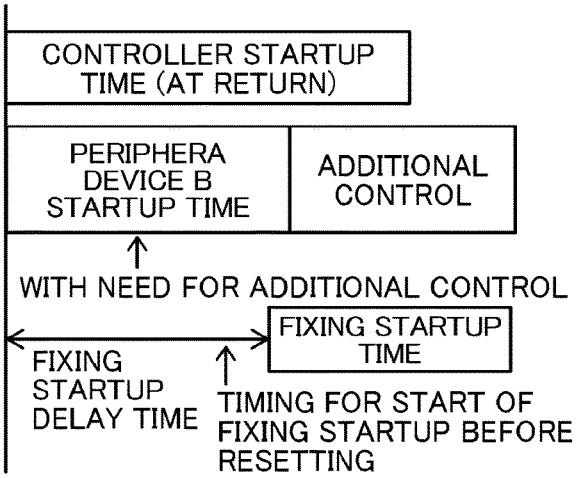

FIGS. 16A to 16D are examples of timing charts of a peripheral device startup operation, a controller startup operation, and a fixing startup operation at a return in the modification of Example 3. FIGS. 16A to 16D are also timing charts with a peripheral device A and a peripheral device B connected to the image forming apparatus. FIG. 16A is an example of a timing chart in a case where there is no instruction to use a peripheral device in the image forming information received by the image forming apparatus in the energy saving mode (where no peripheral device is to be used in the first image formation after a return). On the other hand, FIGS. 16B to 16D are examples of timing charts in a case where there is an instruction to use a peripheral device in the image forming information received by the image forming apparatus in the energy saving mode (where a peripheral device is to be used in the first image formation after a return). FIG. 16B is an example of a timing chart in a case where the image forming information includes an instruction to use the peripheral device A whose peripheral device startup time is longer than the startup time of the controller at a return. FIG. 16C is an example of a timing chart in a case where the image forming information includes an instruction to use the peripheral device B whose peripheral device startup time is shorter than the startup time of the controller at a return. FIG. 16D is an example of a timing chart in a case where an additional control is inserted at the startup of the peripheral device B.

As illustrated in FIGS. 16A to 16D, in the modification of Example 3, as described above, the start of the fixing startup operation is delayed so that the completion of the fixing startup operation coincides with completion of one of the controller startup operation and the peripheral device startup operation at a return, which is longer in startup time. Therefore, as illustrated in FIG. 16C, when the controller startup time at a return is longer than the peripheral device startup time of the peripheral device used, the completion of the fixing startup operation can be adjusted to coincide with the completion of the controller startup operation. This eliminates the fixing standby operation until the completion of the startup operation of the controller 110, thereby causing no unnecessary rotating operation or unnecessary heating operation.

Further, as illustrated in FIG. 16B, when the peripheral device startup time of the peripheral device used is longer than the controller startup time, the completion of the fixing startup operation can be adjusted to coincide with the completion of the peripheral device startup operation. This eliminates the fixing standby operation until the completion of the startup operation of the peripheral device, thereby causing no unnecessary rotating operation or unnecessary heating operation.

Further, as illustrated in FIG. 16D, when an additional control is inserted into the peripheral device startup operation and the peripheral device startup time becomes longer than the controller startup time at a return, the completion of the fixing startup operation can be adjusted to coincide with the completion of the peripheral device startup operation. This eliminates the fixing standby operation even if the completion of the startup operation of the peripheral device is extended due to the additional control, thereby causing no unnecessary rotating operation or unnecessary heating operation.

Figure 17:
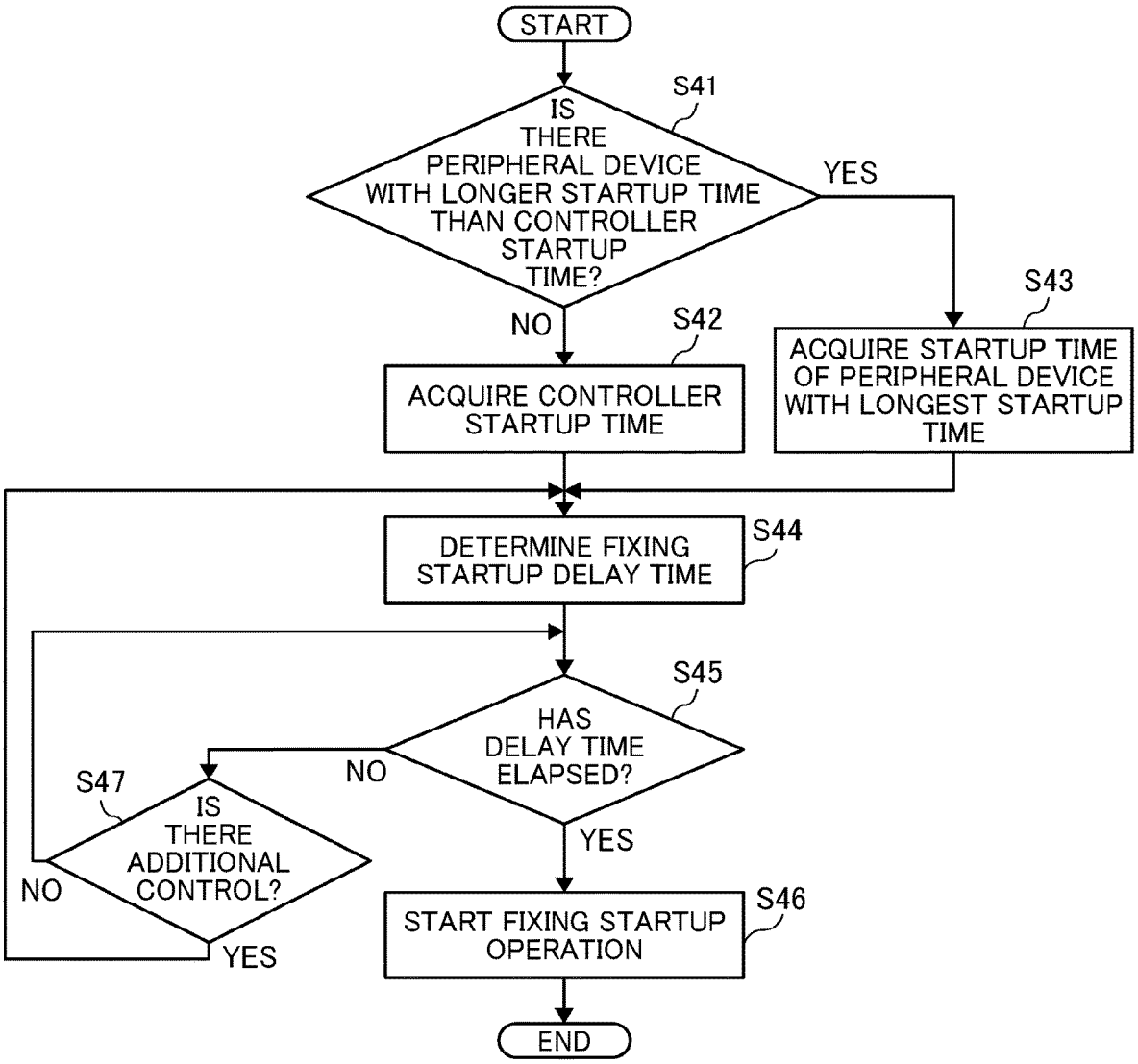
FIG. 17 is a control flowchart of start of the fixing startup operation at turn-on of a power source in the modification of Example 3.

Next, a delay control on start of the fixing startup operation at turn-on of a main power source in the modification of Example 3 will be described. FIG. 17 is a control flowchart of start of the fixing startup operation at turn-on of the main power source in the modification of Example 3. At turn-on of the main power source, the startup operations of all peripheral devices connected to the image forming apparatus are performed. First, the engine control unit 120 checks whether any peripheral device whose startup time is longer than the startup time of the controller at turn-on of the main power source is connected to the image forming apparatus (S41). When no peripheral device whose startup time is longer than the controller startup time at turn-on of the main power source is connected (No in S41), the engine control unit 120 acquires the controller startup time from the storage unit 121 (S42), and subtracts the acquired fixing startup time from the controller startup time to determine the fixing startup delay time (S44) (see FIG. 18A).

On the other hand, when determining that there are peripheral devices whose startup times are longer than the controller startup time among the connected peripheral devices (Yes in S41), the engine control unit 120 acquires the startup time of the peripheral device having the longest startup time among the peripheral devices whose startup times are longer than the controller startup time (S43). Then, the engine control unit 120 subtracts the acquired fixing startup time from the acquired startup time of the peripheral device having the longest startup time to determine the fixing startup delay time (S44) (see FIG. 18B).

Similarly to the above, before the timer reaches the determined fixing startup operation delay time, if an additional control is inserted into the startup operation of the peripheral device (No in S45, Yes in S47), the engine control unit 120 reset the fixing startup delay time (S44).

If having determined the fixing startup delay time based on the controller startup time, the engine control unit 120 adds the additional control time to the startup time of the peripheral device subject to the additional control, and checks whether the peripheral device startup time including the additional control time is longer than the controller startup time. If the peripheral device startup time including the additional control time is longer than the controller startup time, the engine control unit 120 subtracts the fixing startup time from the peripheral device startup time including the additional control time to reset the fixing startup delay time (extends the delay time of the fixing startup operation) (see FIG. 18C). On the other hand, when the peripheral device startup time including the additional control time is shorter than the controller startup time, the engine control unit 120 maintains the firstly determined delay time of the fixing startup operation.

If having determined the fixing startup delay time based on the startup time of the peripheral device having the longest startup time, the engine control unit 120 checks whether the peripheral device subject to the additional control is the peripheral device having the longest startup time described above. When the peripheral device subject to the additional control is the peripheral device having the longest startup time, the engine control unit 120 adds the acquired additional control time to the fixing startup delay time to reset the fixing startup delay time (extends the fixing startup delay time).

If the peripheral device subject to the additional control is not the peripheral device having the longest startup time described above, the engine control unit 120 adds the additional control time to the startup time of the peripheral device subject to the additional control, and checks whether the peripheral device startup time including the additional control time is longer than the startup time of the peripheral device having the longest startup time. If the peripheral device startup time including the additional control time is longer than the startup time of the peripheral device having the longest startup time described above, the engine control unit 120 subtracts the fixing startup time from the peripheral device startup time including the additional control time to reset the delay time of the fixing startup operation (extends the delay time of the fixing startup operation). On the other hand, when the peripheral device startup time including the additional control time is shorter than the startup time of the peripheral device having the longest startup time described above, the engine control unit 120 maintains the firstly determined delay time of the fixing startup operation.

When the timer reaches the fixing startup delay time (Yes in S45), the engine control unit 120 starts the fixing startup operation (S46).

Figure 18A:
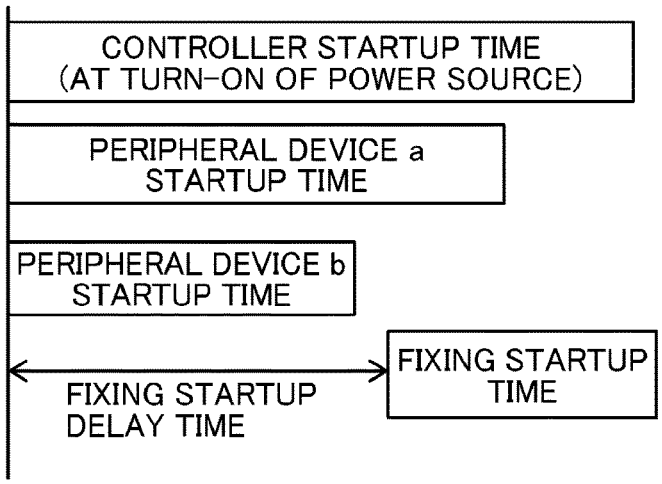
FIGS. 18A to 18C are timing charts of peripheral device startup operations, a controller startup operation, and a fixing startup operation at turn-on of the power source in the modification of Example 3.
Figure 18B:
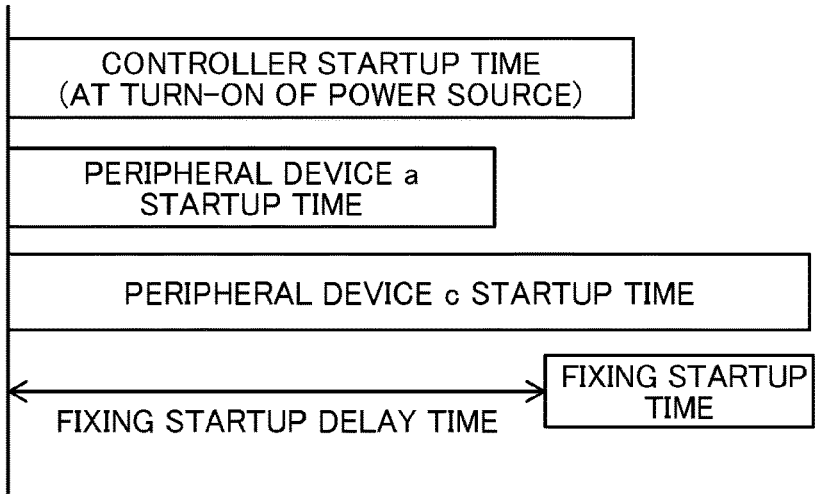
Figure 18C:
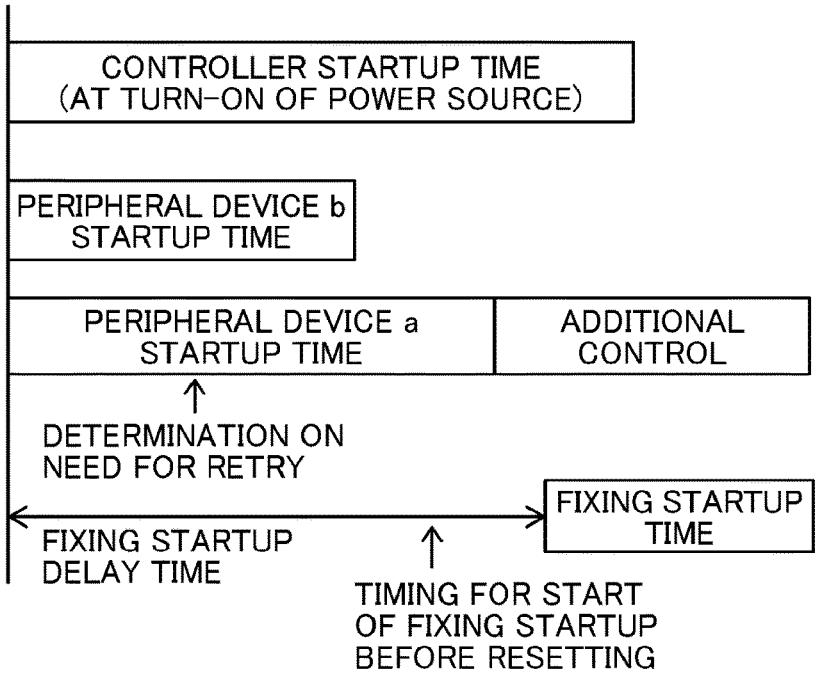

FIGS. 18A to 18C are timing charts of peripheral device startup operations, a controller startup operation, and a fixing startup operation at turn-on of the power source in the modification of Example 3. FIG. 18A is an example of a timing chart in a case where peripheral devices whose startup times are shorter than the controller startup time at turn-on of the main power source is connected to the image forming apparatus. FIG. 18B is an example of a timing chart in a case where a peripheral device whose startup time is longer than the controller startup time at turn-on of the main power source is connected to the image forming apparatus. FIG. 18C is an example of a timing chart in a case where an additional control is performed on a peripheral device.

As illustrated in FIG. 18A, in the modification of Example 3, when the controller startup time at turn-on of the power source is longer than the peripheral device startup time of the peripheral device connected, the completion of the fixing startup operation is adjusted to coincide with the completion of the controller startup operation. This eliminates the fixing standby operation until the completion of the startup operation of the controller 110, thereby causing no unnecessary rotating operation or unnecessary heating operation.

Further, as illustrated in FIG. 18B, when there is a peripheral device whose a startup time is longer than the controller startup time among the peripheral devices connected, the completion of the fixing startup operation can be adjusted to coincide with the completion of the startup operation of the peripheral device having the longest startup time. This eliminates the fixing standby operation until the completion of the startup operation of the peripheral device, thereby causing no unnecessary rotating operation or unnecessary heating operation.

Further, as illustrated in FIG. 18C, when an additional control is inserted into the peripheral device startup operation and the startup time of the peripheral device becomes the longest, the completion of the fixing startup operation can be adjusted to coincide with the completion of the startup operation of the peripheral device. This eliminates the fixing standby operation even if the completion of the startup operation of the peripheral device is extended due to the additional control, thereby causing no unnecessary rotating operation or unnecessary heating operation.

Example 4

Figure 19:
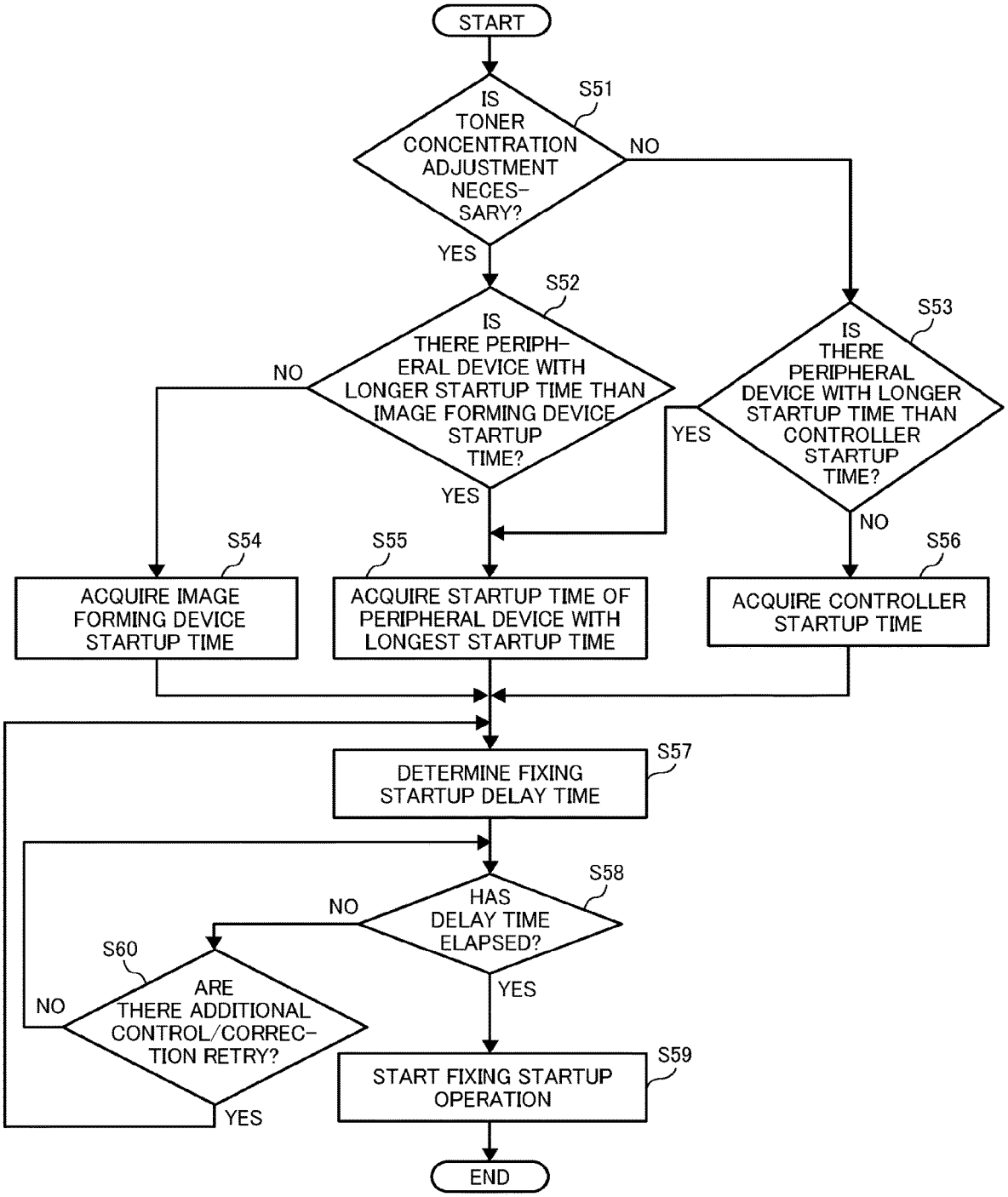
FIG. 19 is a control flowchart on start of a fixing startup operation according to Example 4.

FIG. 19 is a control flowchart on start of a fixing startup operation according to Example 4. As can be seen from FIG. 19, in Example 4, completion of a fixing startup operation is adjusted to coincide with completion of one of an image forming device startup operation, a controller startup operation, and a peripheral device startup operation, which is the longest in startup time. FIG. 19 illustrates a case of an apparatus in which the image forming device startup time is shorter than the controller startup time. First, an engine control unit 120 checks whether toner concentration adjustment is added to the image forming device startup operation as in Example 2 (S51). If the toner concentration adjustment is added to the image forming device startup operation, the image forming device startup time becomes longer than the controller startup time. Thus, when the toner concentration adjustment is added to the image forming device startup operation (Yes in S51), the engine control unit 120 checks whether a peripheral device requiring a longer startup time than the image forming device startup time with the toner concentration adjustment added is connected to the image forming apparatus (S52).

When no peripheral device requiring a longer startup time than the image forming device startup time with the toner concentration adjustment added is connected (No in S52), the image forming device startup operation with the toner concentration adjustment added is the longest in startup time. Thus, the engine control unit 12 acquires the image forming device startup time with the toner concentration adjustment added (the toner concentration adjustment time+ the normal image forming device startup time) (S54), and subtracts the acquired fixing startup time from the image forming device startup time with the toner concentration adjustment added to determine the fixing startup delay time (S57).

On the other hand, when a peripheral device requiring a startup time longer than the image forming device startup time with the toner concentration adjustment added is connected (Yes in S52), the startup time of the peripheral device is the longest. Thus, the engine control unit 120 acquires the startup time of the peripheral device (S55). Then, the engine control unit 120 subtracts the acquired fixing startup time from the startup time of the peripheral device to determine the fixing startup delay time (S57).

Further, if the toner concentration adjustment is not added to the image forming device startup operation (No in S51), the image forming device startup time becomes shorter than the controller startup time. Thus, when the toner concentration adjustment is not added to the image forming device startup operation, the engine control unit 120 checks whether a peripheral device requiring a longer startup time than the controller startup time is connected to the image forming apparatus as in Example 3 (S53).

When no peripheral device requiring a longer startup time than the controller startup time is connected (No in S53), the controller startup operation is the longest in startup time. Thus, the engine control unit 120 acquires the controller startup time (S56), and subtracts the acquired fixing startup time from the controller startup time to determine the fixing startup delay time (S57).

On the other hand, when a peripheral device requiring a startup time longer than the controller startup time is connected (Yes in S53), the startup operation of the peripheral device is the longest. Thus, the engine control unit 120 acquires the startup time of the peripheral device (S55). Then, the engine control unit 120 subtracts the acquired fixing startup time from the startup time of the peripheral device to determine the fixing startup delay time (S57).

After that, as in Examples 2 and 3, if a correction retry occurs in the image forming device startup operation before the fixing delay time (No in S58, Yes in S60), the engine control unit 120 adds the control time of the retry of the correction (image density correction, misregistration correction) to the image forming device startup time. When the startup time of the image forming device startup operation with the correction control time added is longer than other startup times, the engine control unit 120 subtracts the fixing startup time from the startup time of the image forming device startup operation with the correction control time added to reset the fixing startup delay time. On the other hand, if the startup time of the image forming device startup operation with the correction control time added is shorter than other startup times, the engine control unit 120 maintains the determined fixing startup delay time.

If an additional control occurs in the startup operation of the peripheral device before the fixing delay time (No in S58, Yes in S60), the engine control unit 120 adds the additional control time to the startup time of the peripheral device. When the startup time of the peripheral device with the addition becomes the largest, the engine control unit 120 subtracts the fixing startup time from the peripheral device startup time with the additional control time added to reset the fixing startup delay time. On the other hand, if the peripheral device startup time with the additional control time added is shorter than other startup times, the engine control unit 120 maintains the determined fixing startup delay time.

Thus, in Example 4, the completion of the fixing startup operation can be adjusted to coincide with one of the controller startup operation, the image forming device startup operation, and the peripheral device startup operation, which is the latest in completion. This further eliminates an unnecessary fixing standby operation, thereby causing no unnecessary rotating operation or unnecessary heating operation rather than in Examples 1 to 3.

In Examples 1 to 4, the start of the fixing startup operation is delayed. However, at least the start of the rotating operation and the heating operation of the fixing startup operation may be delayed. Therefore, of the fixing startup operation, the pressurizing operation starts at the same time as the startup of the other startup operations. Then, upon lapse of the delay time, the rotational driving of the pressure roller 203 may be started, and then the heating operation may be started. Even such delay control makes it possible to prevent the occurrence of unnecessary rotating operation and unnecessary heating operation, thereby extending the lifetime of the fixing device. However, if the pressurizing time of the pressure roller 203 becomes longer, creep deformation of the nip forming member 124 or the like may proceed, so it is preferable to delay the pressurizing operation as much as possible.

Also, only the start of the heating operation may be delayed. Even if only the start of the heating operation is delayed, it is possible to suppress the generation of unnecessary power consumption, and suppress thermal damage to extend the lifetime of the fixing device.

Further, in a case where the rotating operation is started after the start of the heating operation in a fixing device having a large heat capacity, such as a fixing device using a fixing roller or a fixing device in which a fixing belt is stretched by a plurality of stretching rollers, only the rotating operation may be delayed.

Further, in a fixing device that includes a polishing mechanism for polishing the surface of the fixing belt 201 or the pressure roller 203, when the surface of the member to be polished is polished by the polishing mechanism at startup of the fixing device, a preparation operation of the polishing mechanism may be started at the same time as the start of another startup operation. The preparatory operation of the polishing mechanism herein is an operation of bringing a polishing roller, which is separated from the member to be polished, into contact with the member to be polished. When the surface polishing is to be performed with a web, a web winding operation is the preparatory operation.

The above-described embodiments and modifications of the present disclosure are just examples and have the specific advantages for each of the following aspects.

Aspect 1

In the fixing device that has a first rotating body such as the fixing belt 201 to be heated by a heat source such as the heaters 202A and 202B and a second rotating body such as the pressure roller 203 to be in pressure contact with the first rotating body, and at startup of the device, performs a rotating operation to rotate the first rotating body while performing a heating operation to heat the first rotating body by the heat source such as the heaters 202A and 202B, thereby performing a fixing startup operation to raise the temperature of the first rotating body to a predetermined temperature, at least one of the timing for start of the rotating operation and the timing for start of the heating operation in the fixing startup operation is delayed to be later than the start of the startup operation of the controller 110 such that the fixing startup operation is completed in time with the completion of the startup of the controller 110 that issues an image forming command to a control unit such as the engine control unit 120 that controls components in the image forming apparatus equipped with the fixing device. For example, in an example of an image forming apparatus, the timing for start of a fixing startup operation may be delayed so that the fixing startup operation is completed in time with the completion of a startup operation of an image forming device, thereby to reduce the power consumption and influence on the lifetime of rotating bodies of a fixing device. However, depending on the configuration of the apparatus, the startup operation time of a controller may be longer than the startup operation time of the image forming device and the fixing startup operation time. In the apparatus in which the startup operation time of the controller is the longest, the useless fixing standby mode occurs to keep a first rotating body at a predetermined temperature while rotating the rotating bodies until the completion of the startup operation of the controller. As a result, useless rotating operation and useless heating operation occur, so that power consumption may not be sufficiently reduced, and influence on the lifetime of each rotating body may not be sufficiently reduced. On the other hand, in Aspect 1, at least one of the timing for start of the rotating operation and the timing for start of the heating operation in the fixing startup operation is delayed to be later than the timing for start of the controller startup operation so that the fixing startup operation is completed in time with the completion of the controller startup operation. By delaying the timing for start of the heating operation so that the completion of the fixing startup operation coincides with the completion of the controller startup operation, useless heating operation can be suppressed and power consumption can be reduced. By delaying the timing for start of the rotating operation so that the completion of the fixing startup operation coincides with the completion of the controller startup operation, useless rotating operation can be suppressed, and the influence on the lifetime of each rotating body can be reduced.

Aspect 2

In the fixing device that has a first rotating body such as the fixing belt 201 to be heated by a heat source such as the heaters 202A and 202B and a second rotating body such as the pressure roller 203 to be in pressure contact with the first rotating body, and at startup of the device, performs a rotating operation to rotate the first rotating body while performing a heating operation to heat the first rotating body by the heat source, thereby performing a fixing startup operation to raise the temperature of the first rotating body to a predetermined temperature, at least one of the timing for start of the rotating operation and the timing for start of the heating operation in the fixing startup operation is delayed to be later than the start of one of the controller startup operation of starting up the controller 110 that issues an image forming command to a control unit such as the engine control unit 120 that controls the devices in the image forming apparatus equipped with the fixing device and the peripheral device startup operation of starting up the peripheral device connected to the image forming apparatus, which is later in the completion of startup, so that the fixing startup operation is completed in time with the completion of the one of the startup operations that is later in the completion of startup. According to this, as described with reference to Example 3, depending on the peripheral device connected to the image forming apparatus, the peripheral device may be later in the completion of startup than the controller, or the controller 110 may be later than in the completion of startup than the peripheral device. In Aspect 2, the completion of the fixing startup operation is adjusted to coincide with the completion of one of the controller startup operation and the peripheral device startup operation, which is later in the completion of startup. Accordingly, when the peripheral device starts up later than the controller 110, the completion of the fixing startup operation is adjusted to coincide with the completion of the startup of the peripheral device, which makes it possible to prevent occurrence of a useless rotating operation or heating operation until the completion of the startup of the peripheral device. Further, when the controller 110 starts up later than the peripheral device, the completion of the fixing startup operation is adjusted to coincide with the completion of the startup of the controller, which makes it possible to prevent occurrence of a useless rotating operation or heating operation until the completion of the startup of the controller 110. As a result, the influence on the lifetime of the rotating body in the fixing device and the waste of power consumption can be reduced.

Aspect 3

In Aspect 2, at startup of the image forming apparatus upon receipt of image forming command information, when the image forming command information includes no information on a command to use the peripheral device, at least one of the timing for start of the rotating operation and the timing for start of the heating operation in the fixing startup operation is delayed so that the fixing startup operation is completed in time with the completion of the controller startup operation. According to this, as described in relation to Example 3, when the image forming command information includes no information on a command to use a peripheral device, there is no effect even if the image forming operation is performed without waiting for completion of startup of a peripheral device. Thus, the image forming apparatus performs the image forming operation based on the image forming command information after the startup of the controller 110 is completed. Therefore, when the image forming command information includes no information on a command to use a peripheral device, adjusting the fixing startup operation to complete in time with the completion of the controller startup operation makes it possible to perform the image forming operation immediately after the completion of the controller startup operation and reduce the influence on the lifetime of each rotating body and useless power consumption.

Aspect 4

In Aspect 2 or 3, when the timing for completion of the peripheral device startup operation is changed during the peripheral device startup operation, at least one of the timing for start of the rotating operation and the timing for start of the heating operation in the fixing startup operation is reset. According to this, as described in relation to Example 3, during the startup operation of the peripheral device, an additional control such as returning the operational part to the home position occurs, and the timing for completion of startup of the peripheral device may be changed. As the result of the change in the timing for completion of startup of the peripheral device, the completion of startup of the peripheral device may be later than the completion of startup of the controller. Therefore, in Aspect 4, when the timing for completion of startup of the peripheral device is changed during the startup operation of the peripheral device, at least one of the timing for start of the rotating operation and the timing for start of the heating operation in the fixing startup operation is reset. Accordingly, if the completion of startup of the peripheral device becomes later than the completion of startup of the controller due to the change of the completion timing, the completion of the fixing startup operation can be adjusted to coincide with the completion of startup of the peripheral device, thereby to suppress the occurrence of a useless fixing standby operation. This makes it possible to further reduce the influence on the lifetime of each rotating body and the power consumption.

Aspect 5

In the fixing device that has a first rotating body such as the fixing belt 201 to be heated by a heat source such as the heaters 202A and 202B and a second rotating body such as the pressure roller 203 to be in pressure contact with the first rotating body, and at startup of the device, performs a rotating operation to rotate the first rotating body while performing a heating operation to heat the first rotating body by the heat source, thereby performing a fixing startup operation to raise the temperature of the first rotating body to a predetermined temperature, at least one of the timing for start of the rotating operation and the timing for start of the heating operation in the fixing startup operation is delayed to be later than the start of one of the controller startup operation of starting up the controller 110 that issues an image forming command to a control unit such as the engine control unit 120 that controls the devices in the image forming apparatus equipped with the fixing device and an image forming device startup operation such as an image forming device startup operation of starting up an image forming device such as the image forming device 1 in the image forming apparatus, which is later in the completion of startup, so that the fixing startup operation is completed in time with the completion of the one of the startup operations that is later in the completion of startup. According to this, as described in relation to Example 2, the completion of the image forming device startup operation may be later than the completion of the startup operation of the controller 110 because an additional adjustment control (a control of adjusting the toner concentration in the developing device) is performed due to a difference between the temperature at turn-off of the power source or a shift to the energy saving mode and the temperature at a return. Depending on the image forming apparatus, at turn-on of the power source, the completion of the controller startup operation may be later than the completion of the image forming device startup operation, and conversely, at a return, the completion of the image forming device startup operation may be later than the completion of the controller startup operation. Thus, in Aspect 4, the completion of the fixing startup operation is adjusted to coincide with the completion of one of the controller startup operation and the image forming device startup operation, which is later in the completion of startup. Accordingly, when the image forming device 1 starts up later than the controller, the completion of the fixing startup operation is adjusted to coincide with the completion of the startup of the image forming device 1, which makes it possible to prevent occurrence of a useless rotating operation or heating operation until the completion of the startup of the image forming device 1. Further, when the controller 110 starts up later than the image forming device 1, the completion of the fixing startup operation is adjusted to coincide with the completion of the startup of the controller 110, which makes it possible to prevent occurrence of a useless rotating operation or heating operation until the completion of the startup of the controller 110.

Aspect 6

In Aspect 5, when the timing for completion of the image forming device startup operation is changed during the image forming device startup operation, at least one of the timing for start of the rotating operation and the timing for start of the heating operation in the fixing startup operation is reset. According to this, as described in relation to Example 2, a retry of image density correction and a retry of misregistration correction occur during the startup operation of the image forming device, and the timing for completion of startup of the image forming device is changed (the completion is delayed). As the result of the change in the timing for completion of startup of the image forming device, the completion of startup of the image forming device may be later than the completion of startup of the controller. In Aspect 6, when the timing for completion of startup of the image forming device is changed during the image forming device startup operation, at least one of the timing for start of the rotating operation and the timing for start of the heating operation in the fixing startup operation is reset. Accordingly, if the completion of startup of the image forming device 1 becomes later than the completion of startup of the controller 110 due to the change of the completion timing, the completion of the fixing startup operation can be adjusted to coincide with the completion of startup of the image forming device 1, thereby to suppress the occurrence of a useless fixing standby operation. This makes it possible to further reduce the influence on the lifetime of each rotating body and the power consumption.

Aspect 7

In the fixing device that has a first rotating body such as the fixing belt 201 to be heated by a heat source such as the heaters 202A and 202B and a second rotating body such as the pressure roller 203 to be in pressure contact with the first rotating body, and at startup of the device, performs a rotating operation to rotate the first rotating body while performing a heating operation to heat the first rotating body by the heat source, thereby performing a fixing startup operation to raise the temperature of the first rotating body to a predetermined temperature, at least one of the timing for start of the rotating operation and the timing for start of the heating operation in the fixing startup operation is delayed to be later than the start of one of the controller startup operation of starting up the controller 110 that issues an image forming command to a control unit such as the engine control unit 120 that controls the devices in the image forming apparatus equipped with the fixing device, the peripheral device startup operation of starting up the peripheral device of the image forming apparatus, and the image forming device startup operation of starting up the image forming device 1 of the image forming apparatus, which is the latest in the completion of startup, so that the fixing startup operation is completed in time with the completion of the one of the startup operations that is the latest in the completion of startup. According to this, as described with reference to Example 4, among the controller startup operation, the image forming device startup operation, and the peripheral device startup operation, the startup operation that has the latest startup completion is fixed. By combining the completion of the fixing startup operation, it is possible to suppress the unnecessary fixing standby operation, and it is possible to reduce the influence on the lifetime of the rotating body of the fixing device and the waste of power consumption.

Aspect 8

In Aspect 7, when the timing for completion of the peripheral device startup operation is changed during the peripheral device startup operation or when the timing for completion of the image forming device startup operation is changed during the image forming device startup operation, at least one of the timing for start of the rotating operation and the timing for start of the heating operation in the fixing startup operation is reset. According to this, as described in relation to Example 4, when the completion of the startup of the image forming device 1 becomes the latest or the completion of the startup of the peripheral device becomes the latest due to the change of the completion timing, the completion of the fixing startup operation can be adjusted to coincide with the timing for completion that becomes the latest due to the change of the completion timing. Accordingly, the occurrence of a useless fixing standby operation can be suppressed. This makes it possible to further reduce the influence on the lifetime of each rotating body and the power consumption.

Aspect 9

In any one of Aspects 1 to 8, the timing for start of the rotating operation in the fixing startup operation is delayed. According to this, as described in relation to the embodiment, it is possible to suppress the occurrence of a useless rotating operation and the shortening of lifetime of each rotating body.

Aspect 10

In any one of modes 1 to 9, the timing for start of at least one of the rotating operation and the heating operation in the fixing startup operation is changed depending on the state of the image forming apparatus before startup. According to this, as described with reference to FIGS. 8A, 8B, 9A, 9B, 13A, and 13B, the controller startup time varies depending on the state of the image forming apparatus before startup (power-off or return from the energy saving mode in the present embodiment). Thus, in Aspect 1, changing the timing for start of at least one of the rotating operation and the heating operation in the fixing startup operation depending on the state of the image forming apparatus before startup makes it possible to cause the completion of the fixing startup operation to coincide with the completion of startup of the controller regardless of the state of the image forming apparatus before startup, thereby reducing the influence on the lifetime of each rotating body and power consumption. Further, the controller startup time varies depending on the state of the image forming apparatus before startup (power-off or return from the energy saving mode in the present embodiment), and thus the timing for completion of the startup operation that is the latest in the completion of startup may vary depending on the state of the image forming apparatus. Thus, changing the timing for start of at least one of the rotating operation and the heating operation in the fixing startup operation depending on the state of the image forming apparatus before startup makes it possible to cause the completion of the fixing startup operation to coincide with the completion of the startup operation that is the latest in the completion of startup regardless of the state of the image forming apparatus before startup. Therefore, the influence on the lifetime of each rotating body and the power consumption can be reduced.

Aspect 11

In Aspect 10, the timing for start of at least one of the rotating operation and the heating operation in the fixing startup operation is changed depending on whether the image forming apparatus before startup is in the power-off state or in the energy-saving standby state such as in the energy saving mode. According to this, as described with reference to FIGS. 8A, 8B, 9A, 9B, 13A, and 13B, the influence on the lifetime of each rotating body and the power consumption can be reduced.

Aspect 12

In Aspect 11, the timing for startup from the power-off state is later than the timing for startup from the standby state. According to this, as described with reference to FIGS. 8A, 8B, 9A, 9B, 13A, and 13B, the completion of the fixing startup operation can be adjusted to coincide with the completion of startup of the controller regardless of the state of the image forming apparatus before startup, thereby reducing the influence on the lifetime of each rotating body and power consumption.

Aspect 13

In any one of Aspects 1 to 12, the relay switch 131 is provided to turn on/off the power supply to the heat sources such as the heaters 202A and 202B, and the heating operation includes an operation for turning the relay switch 131 from off to on. According to this, providing the relay switch makes it possible to prevent electric power from being accidentally supplied to heat sources such as heaters.

Aspect 14

In any one of Aspects 1 to 13, in the fixing startup operation, the heating operation is started after the rotating operation. According to this, as described in relation to the embodiment, the first rotating body such as the fixing belt can be uniformly heated in the rotation direction.

Aspect 15

In the image forming apparatus including the image forming device 1 that forms an image, a fixing unit that fixes an image on a recording medium, a control unit such as the engine control unit 120 that controls at least the image forming device 1, and the controller 110 that issues an image forming command to the control unit, the fixing device according to any one of aspects 1 to 14 is used as the fixing unit. According to this, it is possible to reduce the frequency of replacing the fixing device, and it is possible to reduce the power consumption.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus, comprising:

a fixing device including:

a first rotating body;

a second rotating body in pressure contact with the first rotating body; and a heat source configured to heat the first rotating body;

control circuitry configured to control components of the image forming apparatus; and a controller configured to issue an image forming command to the control circuitry, wherein the control circuitry is configured to, at startup of the fixing device, cause the fixing device to perform a rotating operation to rotate the first rotating body while causing the heat source to perform a heating operation to heat the first rotating body, thereby performing a fixing startup operation to raise a temperature of the first rotating body to a predetermined temperature, wherein the control circuitry is further configured to delay at least one of a timing for start of the rotating operation and a timing for start of the heating operation in the fixing startup operation to be later than a particular start time at which a controller startup operation of starting up the controller begins, the controller startup operation beginning when the controller receives power, such that the fixing startup operation is completed at a fixing startup operation completion time that coincides with a completion time of the controller startup operation, wherein after the completion time of the controller startup operation, the controller is configured to issue the image forming command to the control circuitry, wherein the control circuitry is further configured to change the timing for start of the at least one of the rotating operation of the first rotating body and the heating operation by the heat source in the fixing startup operation, depending on an operational state of the image forming apparatus before the particular start time, the operational state being one of a power-off state and an energy-saving standby state, and wherein the control circuitry is further configured to change at least one of the timing for start of the rotating operation and the timing for start of the heating operation in the fixing startup operation, depending on whether the state of the image forming apparatus before the particular start time is a power-off state or an energy-saving standby state.

2. The image forming apparatus according to claim 1, wherein the control circuitry is further configured to delay the timing for start of the rotating operation in the fixing startup operation.

3. The image forming apparatus according to claim 1, wherein the control circuitry is further configured to set a timing for startup from the power-off state to be later than a timing for startup from the standby state.

4. The image forming apparatus according to claim 1, further comprising a relay switch configured to turn on and off power supply to the heat source, wherein the heating operation includes an operation for turning the relay switch from off to on.

5. The image forming apparatus according to claim 1, wherein the control circuitry is further configured to start the heating operation after the rotating operation in the fixing startup operation.

6. The image forming apparatus of claim 1, wherein the control circuitry is further configured to initiate startup of the components of the image forming apparatus, other than the controller and the fixing device, separately from the starting up of the controller and the fixing device.

7. The image forming apparatus of claim 1, wherein the control circuitry is further configured to delay at least one of the timing for start of the rotating operation and the timing for start of the heating operation in the fixing startup operation to be later than a start of one of a first start time at which the controller startup operation of starting up the controller begins and a second start time at which a peripheral device startup operation of starting up a peripheral device connected to the image forming apparatus begins, which is completed later than the other of the controller startup operation and the peripheral device startup operation.

8. An image forming apparatus, comprising:

a fixing device including:

a first rotating body;

a second rotating body in pressure contact with the first rotating body; and a heat source configured to heat the first rotating body;

control circuitry configured to control components of the image forming apparatus; and a controller configured to issue an image forming command to the control circuitry, wherein the control circuitry is configured to, at startup of the fixing device, cause the fixing device to perform a rotating operation to rotate the first rotating body while causing the heat source to perform a heating operation to heat the first rotating body, thereby performing a fixing startup operation to raise a temperature of the first rotating body to a predetermined temperature, and wherein the control circuitry is further configured to delay at least one of a timing for start of the rotating operation and a timing for start of the heating operation in the fixing startup operation to be later than a start of one of a first start time at which a controller startup operation of starting up the controller begins, the controller startup operation beginning when the controller receives power, and a second start time at which a peripheral device startup operation of starting up a peripheral device connected to the image forming apparatus begins, which is completed later than the other of the controller startup operation and the peripheral device startup operation, such that the fixing startup operation is completed at a fixing startup operation completion time that coincides with one of a completion time of the controller startup operation and a completion time of the peripheral device startup operation, wherein after the completion time of the controller startup operation, the controller is configured to issue the image forming command to the control circuitry.

9. The image forming apparatus according to claim 8, wherein, at startup of the image forming apparatus when image forming command information is received, but the image forming command information includes no information on a command to use the peripheral device, the control circuitry is further configured to delay the at least one of the timing for start of the rotating operation and the timing for start of the heating operation in the fixing startup operation to be later than the first start time such that the fixing startup operation is completed at the fixing startup operation completion time, which coincides with the completion time of the controller startup operation.

10. The image forming apparatus according to claim 8, wherein, when the completion time of the peripheral device startup operation is changed during the peripheral device startup operation, the control circuitry is further configured to reset the at least one of the timing for start of the rotating operation and the timing for start of the heating operation in the fixing startup operation.

11. An image forming apparatus, comprising:

an image forming device configured to form an image;

a fixing device including:

a first rotating body;

a second rotating body in pressure contact with the first rotating body; and a heat source configured to heat the first rotating body;

control circuitry configured to control components of the image forming apparatus; and a controller configured to issue an image forming command to the control circuitry, wherein the control circuitry is configured to, at startup of the fixing device, cause the fixing device to perform a rotating operation to rotate the first rotating body while causing the heat source to perform a heating operation to heat the first rotating body, thereby performing a fixing startup operation to raise a temperature of the first rotating body to a predetermined temperature, and wherein the control circuitry is further configured to delay at least one of a timing for start of the rotating operation and a timing for start of the heating operation in the fixing startup operation to be later than a timing for start of a latest one of a first start time at which a controller startup operation of starting up the controller begins, the controller startup operation beginning when the controller receives power, a second start time at which a an image forming device startup operation of starting up the image forming device begins, and a third start time at which peripheral device startup operation of starting up a peripheral device connected to the image forming apparatus begins, which is completed latest of the controller startup operation, the image forming device startup operation, and the peripheral device startup operation, such that the fixing startup operation is completed at a fixing startup operation completion time that coincides with a latest one of a completion time of the controller startup operation, a completion time of the image forming device startup operation, and a completion time of the peripheral device startup operation, wherein after the completion time of the controller startup operation, the controller is configured to issue the image forming command to the control circuitry.

12. The image forming apparatus according to claim 11, wherein, when the completion time of the peripheral device startup operation is changed during the peripheral device startup operation or when the completion time of the image forming device startup operation is changed during the image forming device startup operation, the control circuitry is further configured to reset the at least one of the timing for start of the rotating operation and the timing for start of the heating operation in the fixing startup operation.

13. The image forming apparatus according to claim 11, wherein the control circuitry is further configured to delay the at least one of the timing for start of the rotating operation and the timing for start of the heating operation in the fixing startup operation to be later than one of the first start time at which the controller startup operation of starting up the controller and the second start time at which the image forming device startup operation of starting up the image forming device begins, which is completed later than the other of the controller startup operation and the image forming device startup operation, such that the fixing startup operation is completed at the fixing startup operation completion time, which coincides with one of the completion time of the controller startup operation and the completion time of the image forming device startup operation.

14. The image forming apparatus according to claim 13, wherein, when the completion time of the image forming device startup operation is changed during the image forming device startup operation, the control circuitry is further configured to reset the at least one of the timing for start of the rotating operation and the timing for start of the heating operation in the fixing startup operation.

* * * * *